US010844642B2

(12) United States Patent
Liang et al.

(10) Patent No.: US 10,844,642 B2
(45) Date of Patent: Nov. 24, 2020

(54) COMBINATION FOUR-POSITION SASH LOCK AND TILT LATCH ALSO FUNCTIONING AS A WINDOW OPENING CONTROL DEVICE

(71) Applicant: Vision Industries Group, Inc., So. Plainfield, NJ (US)

(72) Inventors: Luke Liang, So. Plainfield, NJ (US); David Chen, Guangzhou (CN); Glen Paesano, Point Pleasant Beach, NJ (US)

(73) Assignee: VISION INDUSTRIES GROUP, INC., Secaucus, NJ (US)

( * ) Notice: Subject to any disclaimer, the term of this patent is extended or adjusted under 35 U.S.C. 154(b) by 1191 days.

(21) Appl. No.: 14/881,312

(22) Filed: Oct. 13, 2015

(65) Prior Publication Data

US 2016/0069108 A1 Mar. 10, 2016

Related U.S. Application Data

(63) Continuation-in-part of application No. 14/879,436, filed on Oct. 9, 2015, now Pat. No. 10,704,297, and (Continued)

(51) Int. Cl.
*E05C 1/14* (2006.01)
*E05C 17/02* (2006.01)

(Continued)

(52) U.S. Cl.
CPC ..... *E05C 9/028* (2013.01); *E05B 9/08* (2013.01); *E05B 65/0841* (2013.01); *E05C 1/12* (2013.01);

(Continued)

(58) Field of Classification Search
CPC . E05C 9/028; E05C 9/025; E05C 1/12; E05C 3/045; E05C 1/14; E05C 17/02;

(Continued)

(56) References Cited

U.S. PATENT DOCUMENTS 36,524 A 9/1862 Minor
51,222 A 11/1865 Ridell (Continued)

FOREIGN PATENT DOCUMENTS

GB 0341207 1/1931
GB 2026594 2/1980

(Continued)

*Primary Examiner* — Kristina R Fulton
*Assistant Examiner* — Thomas L Neubauer
(74) *Attorney, Agent, or Firm* — Thomas A. O'Rourke; Bodner & O'Rourke, LLP

(57) ABSTRACT

A sash window fastener includes a lock assembly, latch assembly, and stop member. The lock assembly mounts upon the meeting rail, and includes a pivotable cam to engage a keeper on the master frame, and a pivotable arm that acts as a follower. The arm interconnects with the latch within the meeting rail, so cam rotation controls arm positioning—causing translational movement of the latch. The cam can occupy four positions causing four corresponding latch positions: an extended position securing the cam to the keeper, with the latch engaging the master frame to prevent tilting, and contacts a first stop to redundantly lock the window; a first retracted position permitting sliding of the window, but limited by the slightly retracted latch clearing the first stop but contacting a second stop; a second retracted position permitting sliding beyond the second stop, but preventing tilting; and a third retracted position permitting tilting.

8 Claims, 31 Drawing Sheets

Related U.S. Application Data a continuation-in-part of application No. 14/879,164, filed on Oct. 9, 2015, now Pat. No. 10,570,652, and a continuation-in-part of application No. 14/566,908, filed on Dec. 11, 2014, now abandoned, which is a continuation-in-part of application No. 14/278,226, filed on May 15, 2014, now Pat. No. 10,323,446, which is a continuation-in-part of application No. 14/198,986, filed on Mar. 6, 2014, now Pat. No. 10,119,310.

(51) Int. Cl.

| | |
|---|---|
| ***E05C 9/02*** | (2006.01) |
| ***E06B 3/50*** | (2006.01) |
| ***E06B 9/02*** | (2006.01) |
| ***E05C 3/04*** | (2006.01) |
| ***E05C 1/12*** | (2006.01) |
| ***E05B 65/08*** | (2006.01) |
| ***E05B 9/08*** | (2006.01) |
| *E05C 7/00* | (2006.01) |
| *E05C 9/20* | (2006.01) |

(52) U.S. Cl.

CPC ..... *E05C 1/14* (2013.01); *E05C 3/045* (2013.01); *E05C 9/025* (2013.01); *E05C 17/02* (2013.01); *E06B 3/5063* (2013.01); *E06B 9/02* (2013.01); *E05C 9/20* (2013.01); *E05C 2007/007* (2013.01); *Y10T 292/0977* (2015.04)

(58) Field of Classification Search

CPC .. E05C 9/20; E05C 2007/007; E05B 65/0841; E05B 9/08; E06B 9/02; E06B 3/5063; Y10T 292/0977

See application file for complete search history.

(56) References Cited

U.S. PATENT DOCUMENTS 108,778 A 11/1870 Gorman
115,781 A 6/1871 Steele
126,872 A 5/1872 Buckman
148,857 A 3/1874 Smith
166,842 A 8/1875 Berryman
176,360 A 6/1876 Cooper
178,360 A 6/1876 Cooper
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
369,885 A 9/1887 Shaw
375,656 A 12/1887 Shaw
376,252 A 1/1888 McIntyre
379,910 A 3/1888 McIntyre
410,728 A 9/1889 Brown
417,868 A 12/1889 Rosentreter
423,761 A 3/1890 Hasenpflug
452,723 A 5/1891 Schmalhausen
480,148 A 8/1892 Theby
493,159 A 3/1893 Gibson
509,941 A 12/1893 Perry
512,593 A 1/1894 Webster et al.
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dillon
551,242 A 12/1895 Wallace
554,448 A 2/1896 Keil
564,426 A 7/1896 Hubbard
587,424 A 8/1897 Bonine
590,225 A 9/1897 Hill
653,458 A 7/1900 Paquette
683,928 A 10/1901 Geraghty
688,491 A 12/1901 Sigler
695,736 A 3/1902 Kendrick
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hacka
744,755 A 11/1903 Hasenpflug
745,888 A 12/1903 McElwee
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Hearnshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Ailen
887,690 A 5/1908 Pearce
897,719 A 9/1908 Daubaignan
900,079 A 10/1908 Bittorf
910,850 A 1/1909 Petrie
922,894 A 5/1909 Heid
926,899 A 7/1909 Roy
928,408 A 7/1909 Taube
948,628 A 2/1910 Jefferis
959,150 A 5/1910 Morris
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilburn
1,051,918 A 2/1913 Rowley
1,059,999 A 4/1913 James et al.
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,026 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane

(56) References Cited

U.S. PATENT DOCUMENTS 1,177,838 A 4/1916 Wilkinson
1,207,989 A 12/1916 O'Rourke
1,232,683 A 7/1917 Hollis
1,243,115 A 10/1917 Shur
1,247,182 A 11/1917 Tuekmantel
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Keiley
1,322,677 A 1/1919 Ditlefsen
1,311,052 A 7/1919 Danforth
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,601,051 A 9/1925 Wilbert
1,587,037 A 6/1926 Rudolph
1,605,717 A 11/1926 Gregg
1,619,031 A 3/1927 Ostrosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,891,940 A 12/1932 McAllister
1,900,936 A 3/1933 Macy
1,901,974 A 3/1933 Macy
1,922,062 A 8/1933 Sullivan
1,960,034 A 5/1934 Stewart
1,964,114 A 6/1934 Gerlach et al.
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson et al.
2,326,084 A 8/1943 Westrope
2,369,584 A 2/1945 Lundholm
2,452,521 A 10/1948 Johnson et al.
2,480,016 A 8/1949 Granberg
2,480,988 A 9/1949 Waiton
2,500,849 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,590,624 A 3/1952 James
2,599,196 A 6/1952 Peremi
2,605,125 A 7/1952 Emerson
2,612,398 A 9/1952 Miller
2,613,526 A 10/1952 Holmstein
2,621,951 A 12/1952 Ostacal
2,645,515 A 7/1953 Thomas
2,648,967 A 8/1953 Holmstein
2,670,982 A 3/1954 Barnam
2,692,789 A 10/1954 Rivard
2,758,862 A 8/1956 Endter
2,766,492 A 10/1956 Day et al.
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,941,832 A 6/1960 Grossman
2,967,595 A * 1/1961 Zitomer ..... E06B 3/44
292/175
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,599,452 A 8/1971 Yokohama et al.
3,600,019 A 8/1971 Toyota
3,642,615 A 2/1972 Alpern
3,645,573 A 2/1972 Strang
3,683,652 A 8/1972 Halopoff et al.
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Mercer
4,095,827 A 6/1978 Stavenau
4,095,829 A 6/1978 van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham, Jr.
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt et al.
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic
4,991,886 A 2/1991 Nolte
5,042,855 A 8/1991 Bennett
5,072,464 A 12/1991 Draheim et al.

(56) References Cited

U.S. PATENT DOCUMENTS

| | | | |
|---|---|---|---|
| 5,076,015 | A | 12/1991 | Manzalini |
| 5,087,087 | A | 2/1992 | Vetter et al. |
| 5,087,088 | A | 2/1992 | Milam |
| 5,090,750 | A | 2/1992 | Lindqvist |
| 5,090,754 | A | 2/1992 | Thompson |
| 5,110,165 | A | 5/1992 | Piltingsrud |
| 5,127,685 | A | 7/1992 | Dallaire et al. |
| 5,139,291 | A | 8/1992 | Schultz |
| 5,143,412 | A | 9/1992 | Lindqvist |
| 5,161,839 | A | 11/1992 | Piltingsrud |
| 5,165,737 | A | 11/1992 | Riegelman |
| 5,183,310 | A | 2/1993 | Shaughnessy |
| 5,219,193 | A | 6/1993 | Piltingsrud |
| 5,244,238 | A | 9/1993 | Lindqvist |
| 5,248,174 | A | 9/1993 | Matz |
| 5,274,955 | A | 1/1994 | Dallaire et al. |
| 5,341,752 | A | 8/1994 | Hambleton |
| 5,398,447 | A | 3/1995 | Morse |
| 5,437,484 | A | 8/1995 | Yamada |
| 5,448,857 | A | 9/1995 | Stormo |
| 5,452,925 | A | 9/1995 | Huang |
| 5,454,609 | A | 10/1995 | Slocomb et al. |
| 5,560,149 | A | 10/1996 | Lafevre |
| 5,582,445 | A | 12/1996 | Olsen |
| RE35,463 | E | 2/1997 | Vetter |
| 5,636,475 | A | 6/1997 | Nidelkoff |
| 5,688,000 | A | 11/1997 | Dolman |
| 5,715,631 | A | 2/1998 | Kailian et al. |
| 5,741,032 | A | 4/1998 | Chaput |
| 5,778,602 | A | 7/1998 | Johnson |
| 5,791,700 | A | 8/1998 | Biro |
| 5,829,196 | A | 11/1998 | Maier |
| 5,839,767 | A | 11/1998 | Piltingsrud |
| 5,873,199 | A | 2/1999 | Meunier et al. |
| 5,901,499 | A | 5/1999 | Delaske et al. |
| 5,901,501 | A | 5/1999 | Fountaine |
| 5,911,763 | A | 6/1999 | Quesada |
| 5,927,768 | A | 7/1999 | Dallmann |
| 5,970,656 | A | 10/1999 | Maier |
| 5,992,907 | A | 11/1999 | Sheldon et al. |
| 6,000,735 | A | 12/1999 | Jourdenais |
| 6,086,121 | A | 7/2000 | Buckland |
| 6,116,665 | A | 9/2000 | Subliskey |
| 6,135,510 | A | 10/2000 | Diginosa |
| 6,139,071 | A | 10/2000 | Hopper |
| 6,142,541 | A | 11/2000 | Rotondi |
| 6,155,615 | A | 12/2000 | Schultz |
| 6,161,335 | A | 12/2000 | Beard et al. |
| 6,176,041 | B1 | 1/2001 | Roberts |
| 6,178,696 | B1 | 1/2001 | Liang |
| 6,183,024 | B1 | 2/2001 | Schultz et al. |
| 6,209,931 | B1 | 4/2001 | Stoutenborough et al. |
| 6,217,087 | B1 | 4/2001 | Fuller |
| 6,230,443 | B1 | 5/2001 | Schultz |
| 6,257,303 | B1 | 7/2001 | Coubray et al. |
| 6,279,266 | B1 | 8/2001 | Searcy |
| 6,349,576 | B2 | 2/2002 | Subliskey |
| 6,364,375 | B1 | 4/2002 | Szapucki |
| 6,422,287 | B1 | 7/2002 | Wilke |
| 6,546,671 | B2 | 4/2003 | Mitchell et al. |
| 6,565,133 | B1 | 5/2003 | Timothy |
| 6,588,150 | B1 | 7/2003 | Wong et al. |
| 6,592,155 | B1 | 7/2003 | Lemley et al. |
| 6,607,221 | B1 | 8/2003 | Elliott |
| 6,631,931 | B2 | 10/2003 | Magnusson |
| 6,634,683 | B1 | 10/2003 | Brannan |
| 6,817,142 | B2 | 11/2004 | Marshik |
| 6,848,728 | B2 | 2/2005 | Rotondi |
| 6,871,885 | B2 | 3/2005 | Goldenberg et al. |
| 6,871,886 | B2 | 3/2005 | Coleman |
| 6,877,784 | B2 | 4/2005 | Kelley et al. |
| 6,925,753 | B1 | 8/2005 | Pettit |
| 6,957,513 | B2 | 10/2005 | Pettit |
| 6,983,963 | B2 | 1/2006 | Estick |
| 7,000,957 | B2 | 2/2006 | Lawrence |
| 7,013,603 | B2 | 3/2006 | Eenigenburg et al. |
| 7,063,361 | B1 | 6/2006 | Lawrence |
| 7,070,211 | B2 | 7/2006 | Polowinczak et al. |
| 7,070,215 | B2 | 7/2006 | Kelley |
| 7,100,951 | B2 | 9/2006 | Jien |
| 7,147,255 | B2 | 12/2006 | Goldenberg |
| 7,159,908 | B2 | 1/2007 | Liang |
| 7,296,831 | B2 | 11/2007 | Generowicz |
| 7,322,620 | B1 | 1/2008 | Lawrence |
| 7,407,199 | B2 | 8/2008 | Richardson |
| 7,481,470 | B2 | 1/2009 | Polowinczak |
| 7,510,221 | B2 | 3/2009 | Eenigenburg |
| 7,607,262 | B2 | 10/2009 | Eenigenburg |
| 7,665,775 | B1 | 2/2010 | Miller |
| 7,922,223 | B2 | 4/2011 | Lawrence |
| 7,976,077 | B2 | 7/2011 | Flory |
| 8,205,919 | B2 | 6/2012 | Fiory |
| 8,205,920 | B2 | 6/2012 | Fiory |
| 8,272,164 | B2 | 9/2012 | Albrecht |
| 8,550,507 | B2 | 10/2013 | Barton |
| 8,726,572 | B2 | 5/2014 | Derham |
| 8,789,862 | B2 | 7/2014 | Liang |
| 8,844,985 | B2 | 9/2014 | Liang |
| 9,140,033 | B2 | 9/2015 | Wolf |
| 2006/0192391 | A1 | 8/2006 | Pettit |
| 2006/0244270 | A1 | 11/2006 | Rotondi |
| 2007/0205615 | A1 | 9/2007 | Eenigenburg |
| 2008/0169658 | A1 | 7/2008 | Wolf |
| 2010/0199726 | A1 | 8/2010 | Varney |
| 2010/0218425 | A1* | 9/2010 | Nolte ..... E05B 53/003 49/185 |
| 2010/0263415 | A1 | 10/2010 | Rupsil |
| 2013/0214545 | A1 | 8/2013 | Wolf |
| 2013/0283695 | A1 | 10/2013 | Hollermann |
| 2016/0076282 | A1 | 3/2016 | Wolf |

FOREIGN PATENT DOCUMENTS

| | | |
|---|---|---|
| GB | 2286627 | 8/1995 |
| GB | 2461079 | 12/2009 |
| GB | 2461107 | 12/2009 |
| GB | 2461108 | 12/2009 |

* cited by examiner

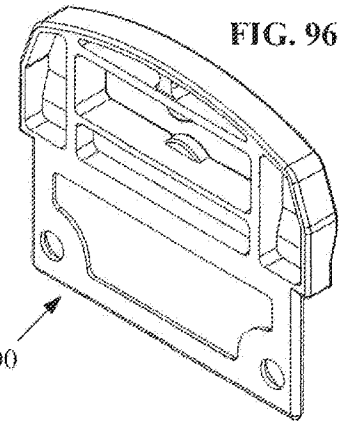
FIG. 96
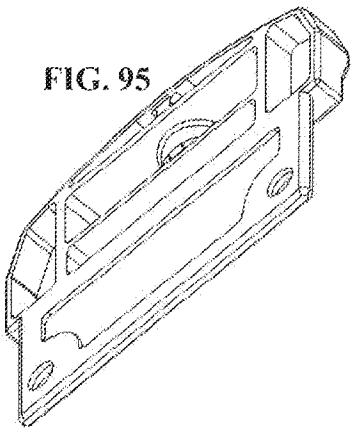
FIG. 95
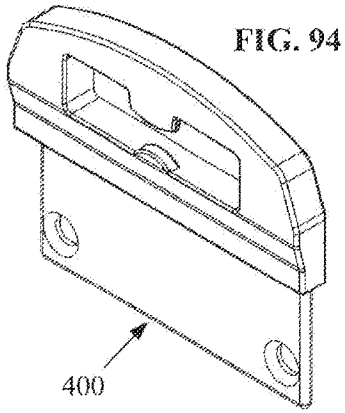
FIG. 94
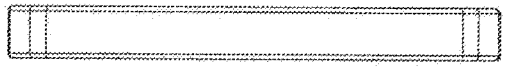
FIG. 98
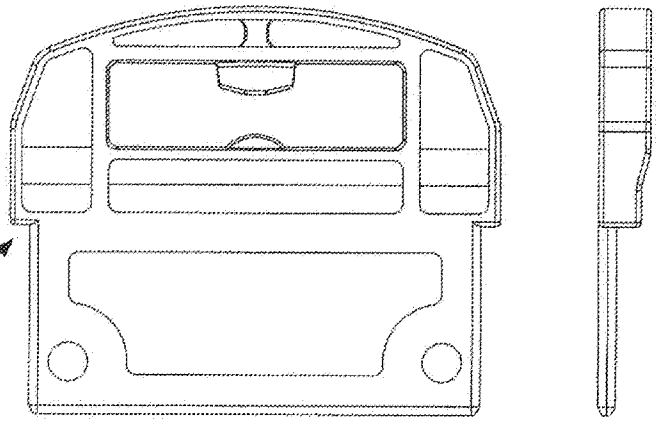
FIG. 97
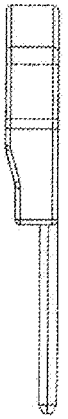
FIG. 101
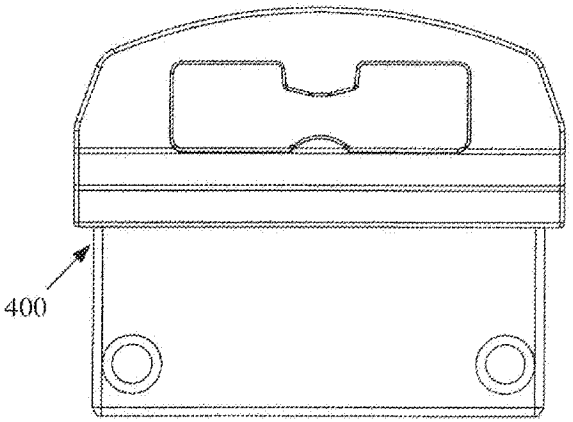
FIG. 102
FIG. 100
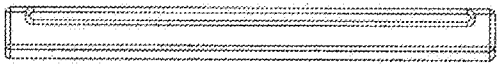
FIG. 99

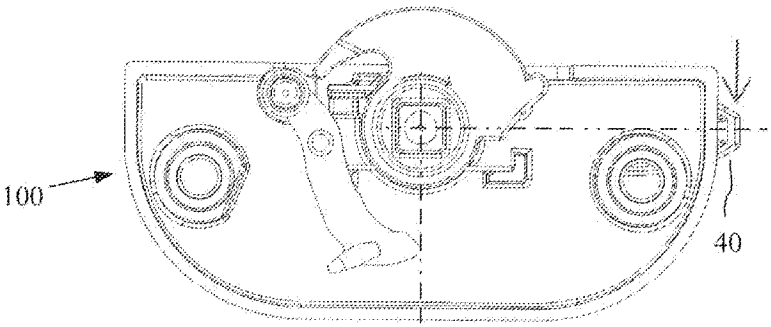
FIG. 125A
FIG. 125B
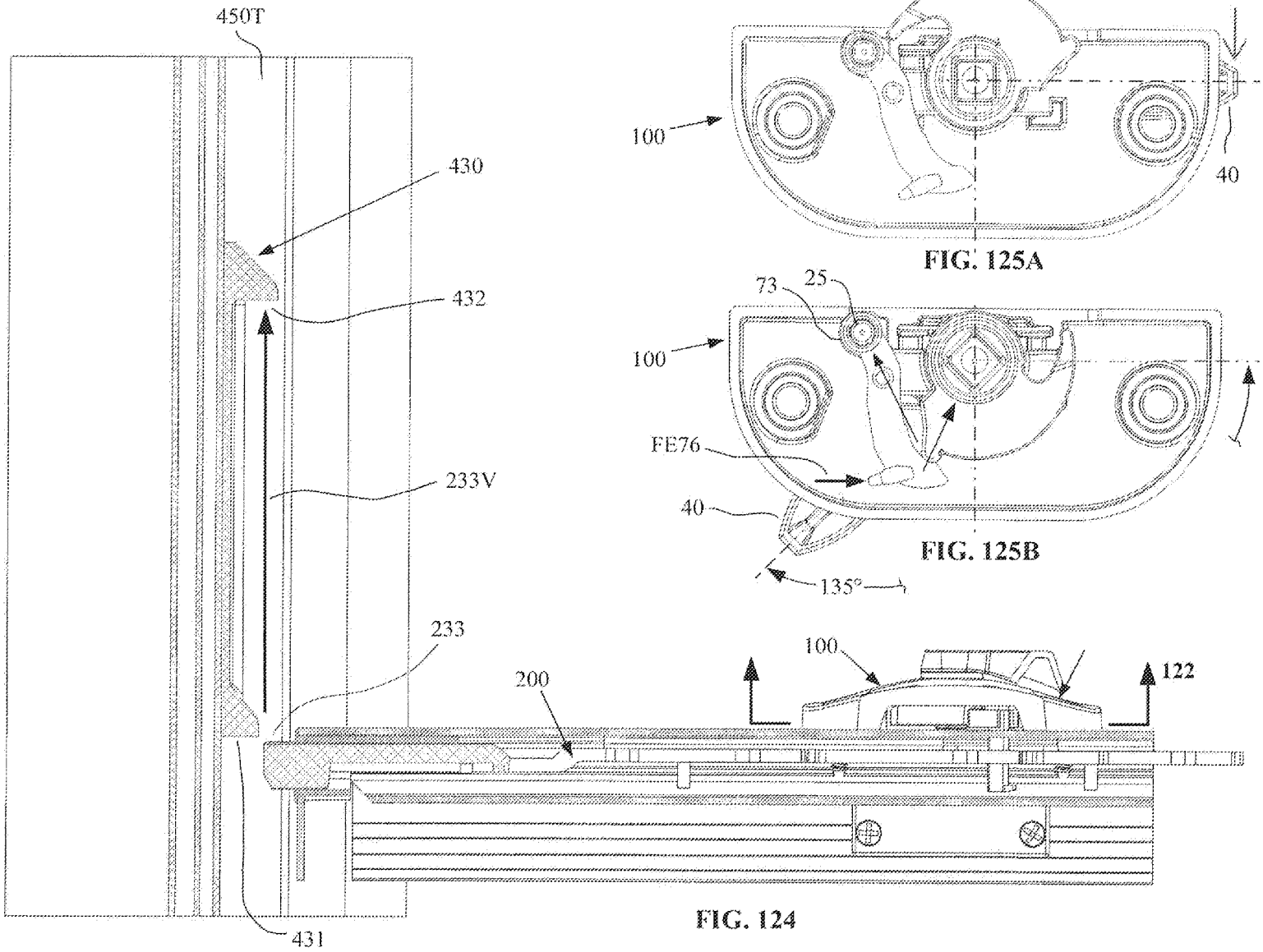
FIG. 124

COMBINATION FOUR-POSITION SASH LOCK AND TILT LATCH ALSO FUNCTIONING AS A WINDOW OPENING CONTROL DEVICE

CROSS REFERENCE TO RELATED APPLICATIONS

This application is a continuation-in-part of U.S. application Ser. No. 14/879,436, having the title "Impact-Resistant Lock and Tilt Latch Combination for a Sliding Sash Window," and U.S. application Ser. No. 14/879,164, having the title "Integrated Sash Lock and Tilt Latch Combination Using One Lock for Two Tilt Latches." each of which were filed on Oct. 9, 2015, and which are a continuation-in-part of U.S. patent application Ser. No. 14/566,908, filed on Dec. 11, 2014, having the title "Integrated Sash Lock and Tilt Latch Combination with Improved Wind-Force-Resistance Capability," which is a continuation-in-part of U.S. patent application Ser. No. 14/278,226, filed on May 15, 2014, having the title "Integrated Sash Lock and Tilt Latch Combination with Improved Interconnection Capability Therebetween," which is a continuation-in-part of U.S. patent application Ser. No. 14/198,986, filed on Mar. 6, 2014, having the title "Integrated Sash Lock and Tilt Latch with Screwless Installation and Removal from Meeting Rail," with the disclosures of each being incorporated herein by reference.

FIELD OF THE INVENTION

The present invention relates to improvements in locks and tilt latches for slidable sash windows, and more particularly to improvements to an integral sash lock/tilt latch combination that furthermore includes a window vent stop capability.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of these sliding sash windows, it is common for window manufacturers to incorporate a tilt latch device thereon that permits one end of the sliding sash window to be released from the track of the master window frame. This allows the sash window to be pivoted into the room, for easy access to the exterior surface of the glazing that is normally exposed to the exterior environment of the building.

The present invention seeks to provide improvements to such window hardware in the form of an integrated sash lock and tilt latch fastener for single hung or double hung windows.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single cam.

It is another object of the invention to provide a sash lock and tilt latch that may act cooperatively to furthermore limit the travel of a window to provide a vent opening that is too small to permit egress of a small child therefrom.

It is also an object of the invention to provide a sash lock that may be blindly coupled to a tilt latch device for cooperative interaction and actuation of the latch.

Further objects and advantages of the invention will become apparent from the following description and claims, and from the accompanying drawing figures.

SUMMARY OF THE INVENTION

An integral sash locking and tilt latching fastener for a sliding sash window may include a lock assembly that may be interconnected with a latch assembly.

The lock assembly may be mounted to the top of the meeting rail of the sash window. The lock assembly may include a housing and a cam pivotally mounted to the housing, being configured to pivot out from a cavity in the housing to releasably engage a keeper on the master window frame (or on a second sliding sash window) in a "lock" position, to lock the sash window (or windows) and prevent it from sliding and/or tilting. The lock assembly also includes a lever arm that may be pivotally mounted within the lock housing, and which may be configured for a portion thereof to extend beyond the mounting surface of the housing, and into the hollow of the meeting rail. The cam may have a graspable shaft portion that may protrude upwardly, out from an orifice in the sash lock housing, to permit actuation of the device (cam rotation) by a user. Alternatively, the device may have a separate handle member secured to the cam, where the handle may facilitate easy rotation and counter-rotation of the cam.

The latch assembly may be received through an opening on a side of the sash member. The latch assembly may include a housing, biasing means, and a latch member slidably disposed within the housing. The latch member is configured to receive the lever arm of the lock assembly, when positioned within the hollow meeting rail, for coupling therebetween. The housing, latch member, and biasing means are configured for the biasing means to normally bias the latch member, so that a portion of one end (i.e., a portion of its "tongue") may protrude out from the housing, and out of the sash window frame.

With the cam releasably secured in the "lock" position (e.g., using a detent mechanism), the cam may prevent sliding of the sash window through its engagement with the keeper, the latch member is also in its fully extended position which would prevent tilting of the sash window. The sash window may be redundantly locked with respect to any sliding motion within the master window frame by a stop member, which may be secured in the track of the master window frame within which the sash member slides. A first step of the stop member may protrude a first distance into the track, and may thereat block sliding movement of the tongue of the latch member that is biased to protrude therein, to provide a secondary lock feature with respect to sliding of the window away from its closed position.

When actuation of the shaft/handle member causes the cam to rotate (e.g., 135 degrees from the lock position), it may move the cam from the extended lock position into a first retracted cam position—a position where the cam is disengaged from the keeper on the master window frame, and would no longer prevent the sash window from sliding. Rotation of the cam into the first retracted cam position may cause a portion thereof to contact a follower portion of the lever arm and thereby drive the lever arm to also rotate, which rotation may act to oppose the biasing of the latch member to actuate it a discrete amount, through the interconnection therebetween, to move the latch member into a corresponding first retracted latch member position. With the latch member in the first retracted latch member position, the end of its tongue may be positioned clear of the first step of the stop member, so that the sash window may slide away from its closed position. However, a second step on the stop member may protrude a second distance, being further into the track of the master frame, and may be positioned at a discrete height above the first step, which may nonetheless still block sliding movement of the latch member.

This may provide a vent stop feature that permits sliding of the sash window from its closed position but only up to small elevated position that may form an opening small enough to prevent accidental egress by a small child or ingress by an intruder, but which nonetheless provides ventilation. With the latch member in its first retracted position, a portion of its tongue remains engaged within the track of the master window frame, and thereat still serves to prevent tilting of the sash member out from the master window frame. Note that the detent mechanism may releasably secure the cam at the first retracted cam position, thereby also releasably securing the latch member at the first retracted latch member position, due to the interconnection therebetween.

When continued actuation of the shaft/handle member causes the cam to further rotate a discrete amount (e.g., an additional 25 degrees—being 160 degrees from the cam's lock position), to move from the first retracted position to a second retracted position, the cam may further drive the lever arm to correspondingly rotate a discrete amount, and thus move the latch member into a second retracted latch member position. With the latch member in the second retracted latch member position, the end of the tongue is then positioned clear of the second step of the stop member, so that the sliding movement of the sash window is no longer limited, and it may now slide anywhere between a fully closed position and a fully open position. However, the tongue nonetheless still remains engaged within the track of the master window frame, and thus still serves to prevent tilting of the sash member out from the master window frame.

When continued actuation of the shaft/handle member causes the cam to further rotate another discrete amount (e.g., an additional 20 degrees—being 180 degrees from the cam's lock position), to move from the second retracted position to a third retracted position, the cam further drive the lever arm to correspondingly rotate a discrete amount, and move the latch member into a third retracted latch member position. With the latch member in the third retracted latch member position, the end of the tongue is then disengaged from the track of the master window frame, and the sash window is free to be tilted out of the master window frame. Note that the detent mechanism may also releasably secure the cam at the second and third retracted cam position, thereby also releasably securing the latch member at the third retracted latch member position.

Both a left-hand and right-hand version of the above described integral sash locking and tilt latching fastener and corresponding stepped stop may be mounted on a sliding sash window and master frame. Alternatively, only the left-hand or the right hand arrangement may be used to secure the window as described. The following discussion proceeds with a discussion of one version of the fastener, with the understanding that a mirror image may also be formed and used on the window.

BRIEF DESCRIPTION OF THE DRAWINGS

FIG. 94 is a perspective view of a keeper that may be mounted on a master window frame in which the sash window slides (or a second sash window), to be useable for securing the cam of the lock assembly of FIG. 1 to lock the sliding sash window(s).

FIG. 95 is a second perspective view of the keeper shown in FIG. 94.

FIG. 96 is a third perspective view of the keeper shown in FIG. 94.

FIG. 97 is a front view of the keeper shown in FIG. 94.

FIG. 98 is a top view of the keeper shown in FIG. 94.

FIG. 99 is a bottom view of the keeper shown in FIG. 94.

FIG. 100 is a first end view of the keeper shown in FIG. 94.

FIG. 101 a second end view of the keeper shown in FIG. 94.

FIG. 102 is a rear view of the keeper shown in FIG. 94.

FIG. 118 is a cross-section cut normal to the sash window frame engaged with the master window frame, as seen in FIG. 117.

FIG. 119 is a cross-section showing the side of the sash window frame engaged with the master window frame, as seen in FIG. 117.

FIG. 120 is the cross-section of FIG. 118, shown as a view with the stepped stop of FIG. 103 mounted within the track of the master window frame.

FIG. 121 is the cross-section of FIG. 119, shown as a view with the stepped stop of FIG. 103 mounted within the track of the master window frame, and shown with the cam of the sash lock in the extended locked position, and the latch member in the corresponding extended position, to engage a first step of the stop and redundantly lock the window in the window closed position.

FIG. 122 is a bottom view of the sash lock with the cam and shaft/handle member shown in the locked position, as seen in FIG. 121.

FIG. 123 is a perspective view of the arrangement shown in FIG. 121, with the cam of the sash lock in the extended locked position, and the latch member in the corresponding extended position, to engage a first step of the stop and redundantly lock the window in the window closed position.

FIG. 124 is the cross-section of FIG. 121, but shown with the cam and shaft/handle member of the sash lock in the first retracted position, and with the latch member moved into the corresponding retracted position, to disengage from the first step of the stop and unlock the window, to permit sliding movement of the window away from the window closed position.

FIG. 125A is the bottom view of the sash lock shown in FIG. 122, but with arrows indicating a force applied to the shaft/handle member that may cause the indicated rotation of the cam, to move the cam into the first retracted position shown in FIG. 124.

FIG. 125B is a bottom view of the sash lock with the cam and shaft/handle member in the first retracted position, as seen in FIG. 124, showing engagement of a rounded protrusion on the cam with the follower portion of the lever arm.

FIG. 126 is a perspective view of the arrangement shown in FIG. 124, with the cam of the sash lock in the first retracted position, and the latch member in the corresponding retracted position.

FIG. 127 is the cross-section of FIG. 124, with the cam and shaft/handle member of the sash lock still in the first retracted position, and with the latch member still in the corresponding first retracted latch position, but is shown after the window has been slid open into an open-limited position in which the tongue of the latch member engages a second step on the stop.

FIG. 128 is a perspective view of the arrangement shown in FIG. 127.

Figure 127:
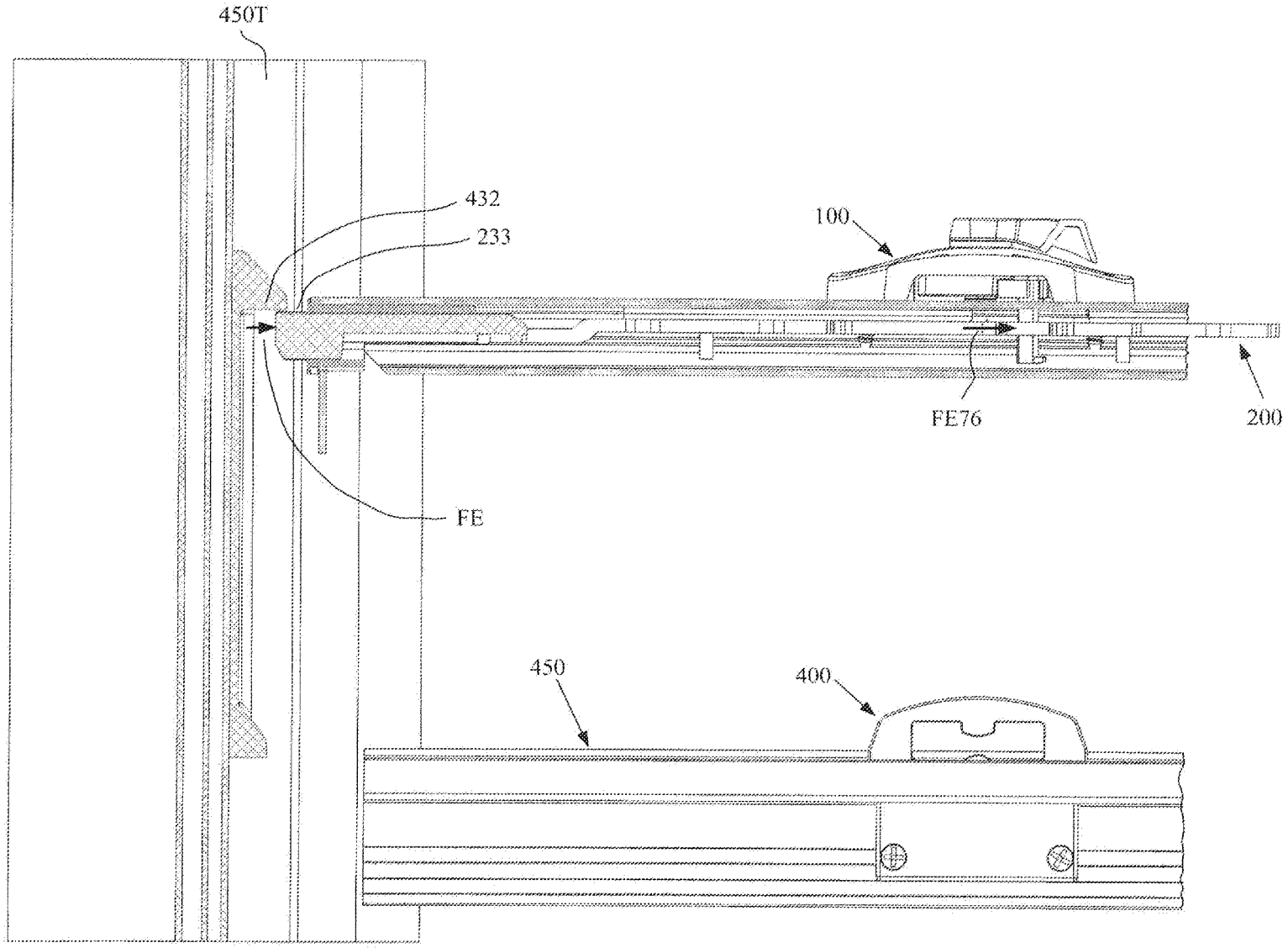
Figure 129:
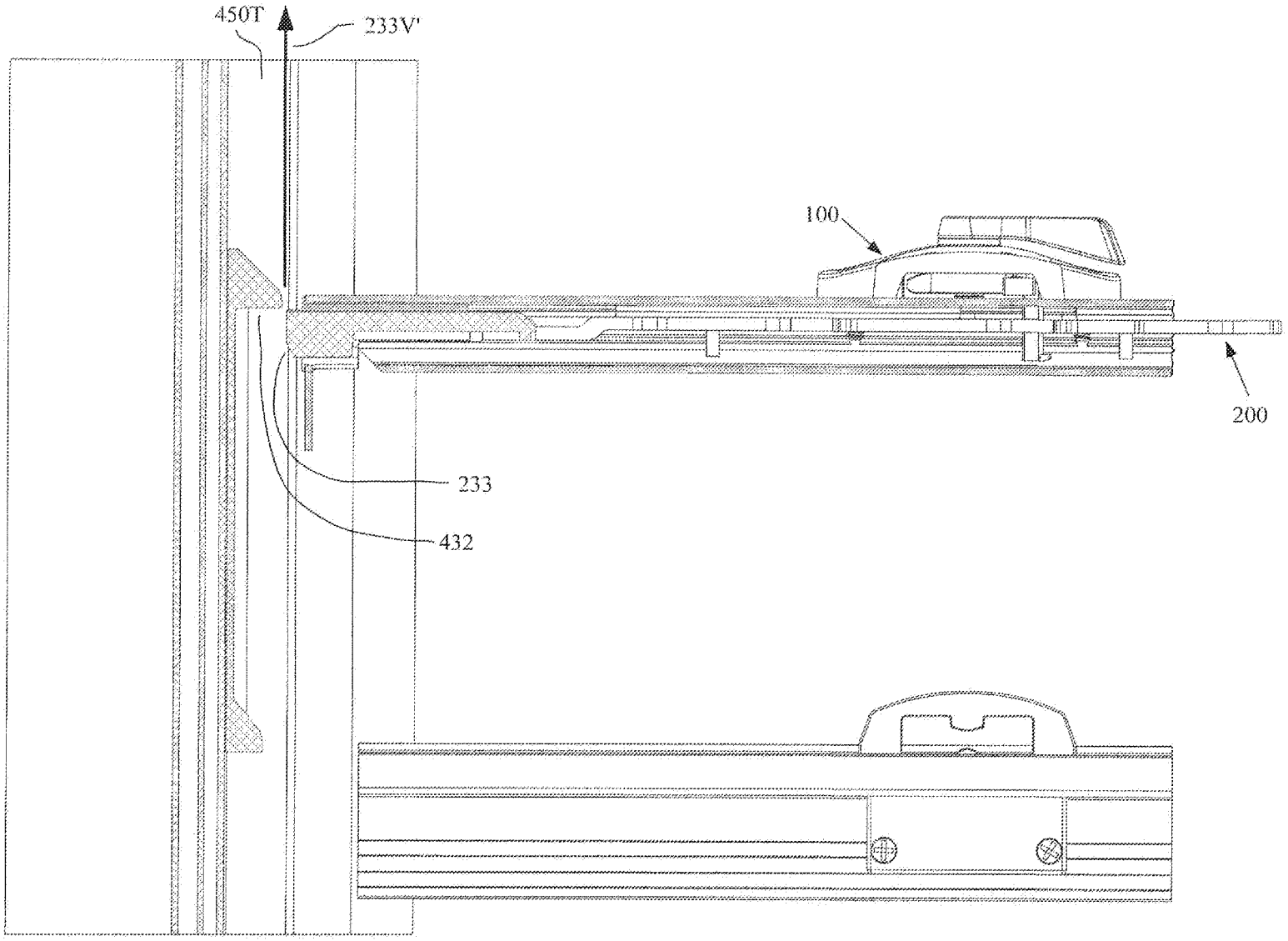

FIG. 129 is the cross-section of FIG. 127, but shown with the cam and shaft/handle member of the sash lock in the second retracted position, and with the latch member moved into the corresponding second retracted latch position, to disengage from the second step of the stop, to permit sliding movement of the window beyond the open-limited position, but which still engages the master frame to prevent tilting of the window therefrom.

Figure 130B:
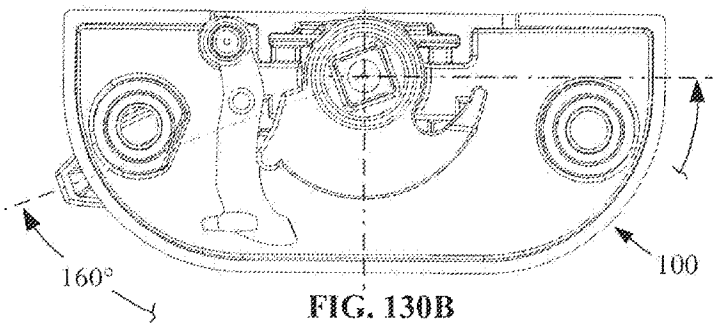
Figure 130A:
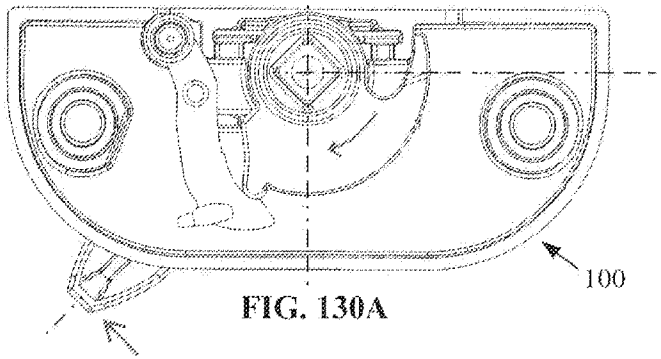

FIG. 130A is the bottom view of the sash lock shown in FIG. 125B, but with arrows indicating a force applied to the shaft/handle member that may cause the indicated rotation of the cam, to move the cam into the second retracted position shown in FIG. 129.

FIG. 130B is a bottom view of the sash lock with the cam and shaft/handle member in the second retracted position, as seen in FIG. 129, showing engagement of the rounded protrusion on the cam at a different location of the follower portion of the arm.

Figure 131B:
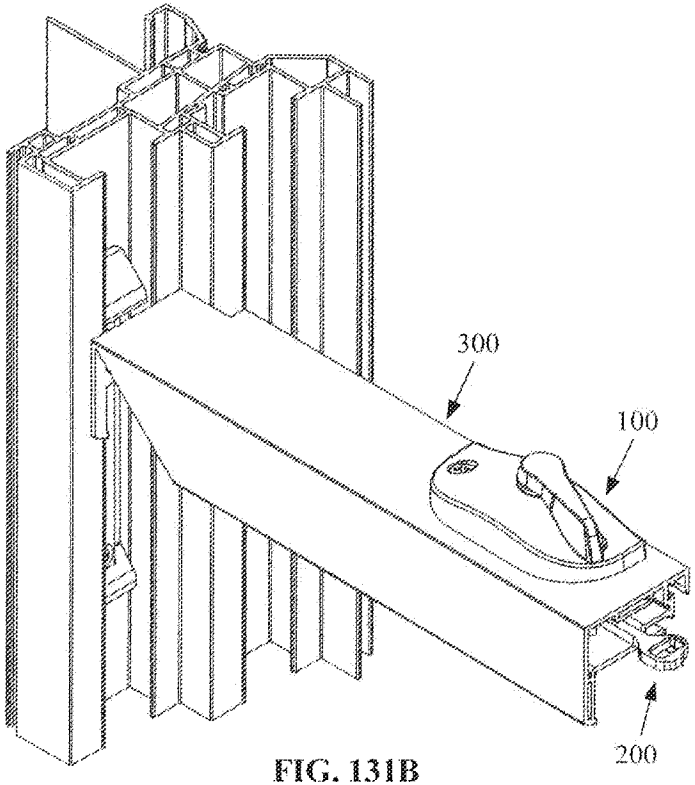
Figure 131A:
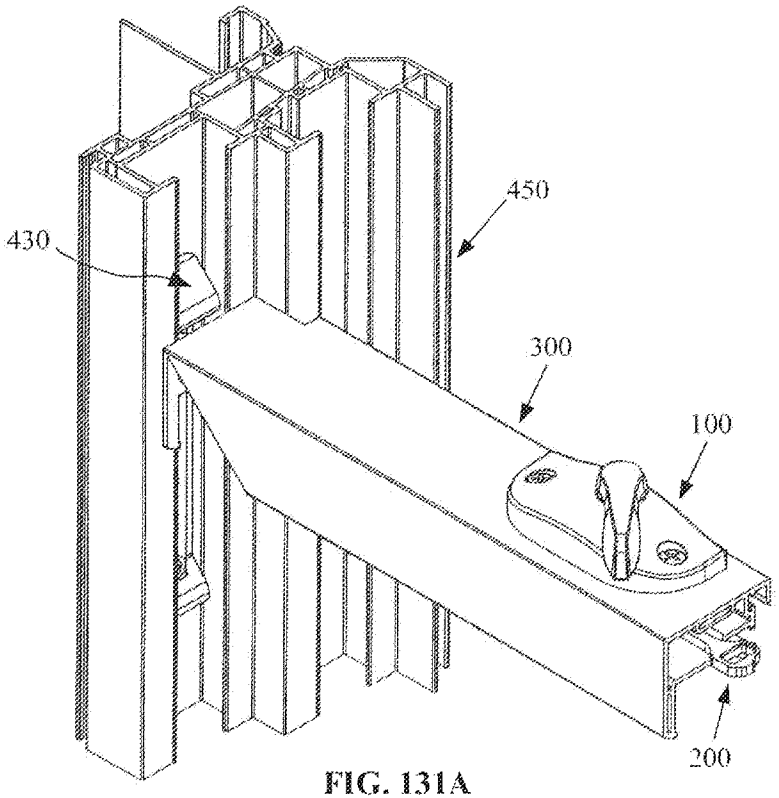

FIG. 131A is a perspective view of the arrangement of FIG. 130A, with the shaft/handle member shown rotated 135 degrees from the locked position to be at the first retracted position.

FIG. 131B is a perspective view of the arrangement of FIG. 130B, with the shaft/handle member shown rotated 160 degrees from the locked position to be at the second retracted position.

Figure 132:
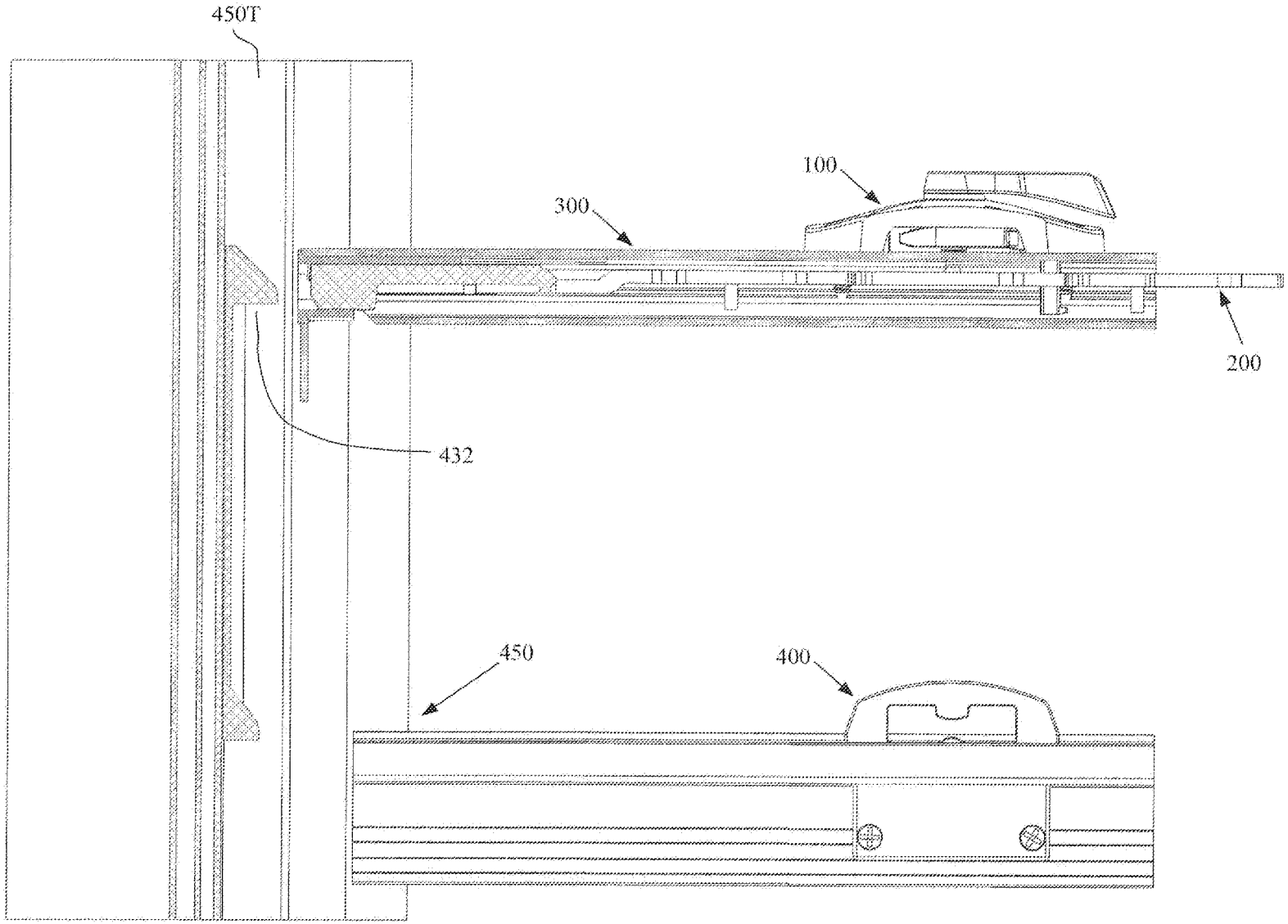

FIG. 132 is the cross-section of FIG. 129, but shown with the cam and shaft/handle member of the sash lock in the third retracted position, and with the latch member moved into the corresponding third retracted latch position, to be disengaged from the master frame, to permit tilting of the window therefrom.

Figure 133B:
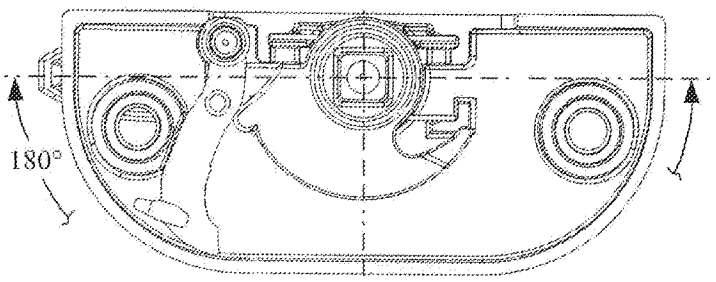
Figure 133A:
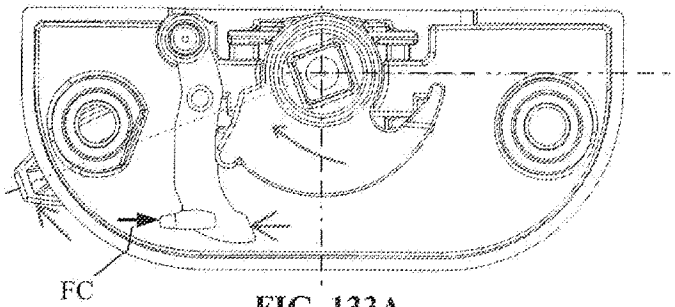

FIG. 133A is the bottom view of the sash lock shown in FIG. 130B, but with arrows indicating a force applied to the shaft/handle member that may cause the indicated rotation of the cam, to move the cam into the third retracted position shown in FIG. 132.

FIG. 133B is a bottom view of the sash lock with the cam and shaft/handle member in the third retracted position, as seen in FIG. 132, showing engagement of the rounded protrusion on the cam at a different location of the follower portion of the lever arm.

Figure 134B:
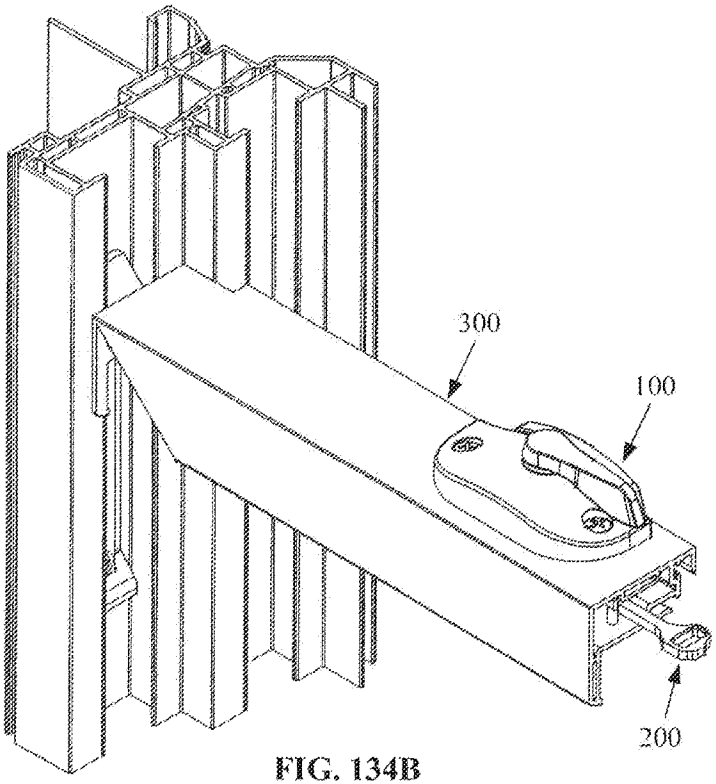
Figure 134A:
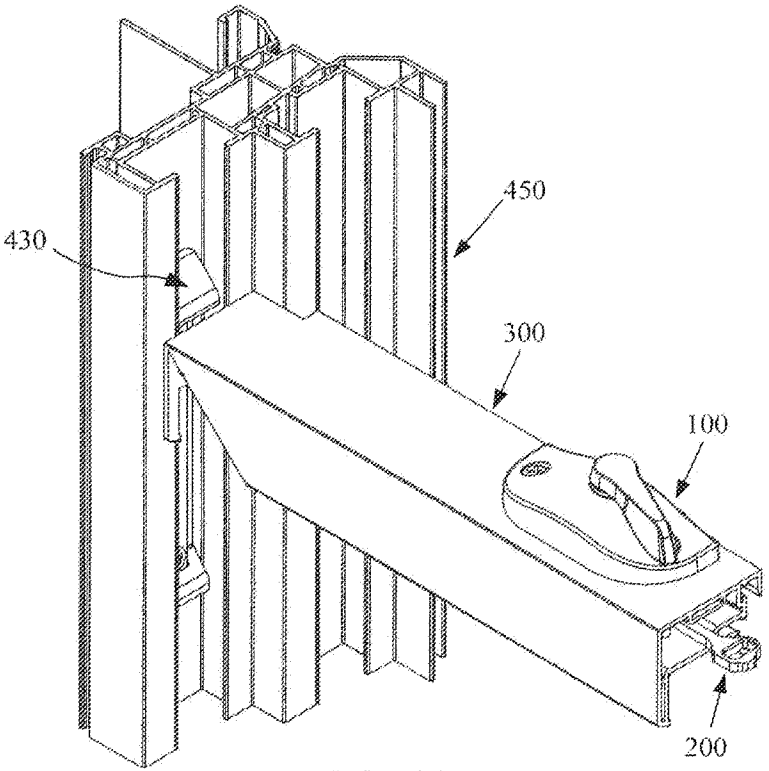

FIG. 134A is a perspective view of the arrangement of FIG. 133A, with the shaft/handle member shown rotated 160 degrees from the locked position to be at the second retracted position.

FIG. 134B is a perspective view of the arrangement of FIG. 133B, with the shaft/handle member shown rotated 180 degrees from the locked position to be at the third retracted position.

Figure 135:
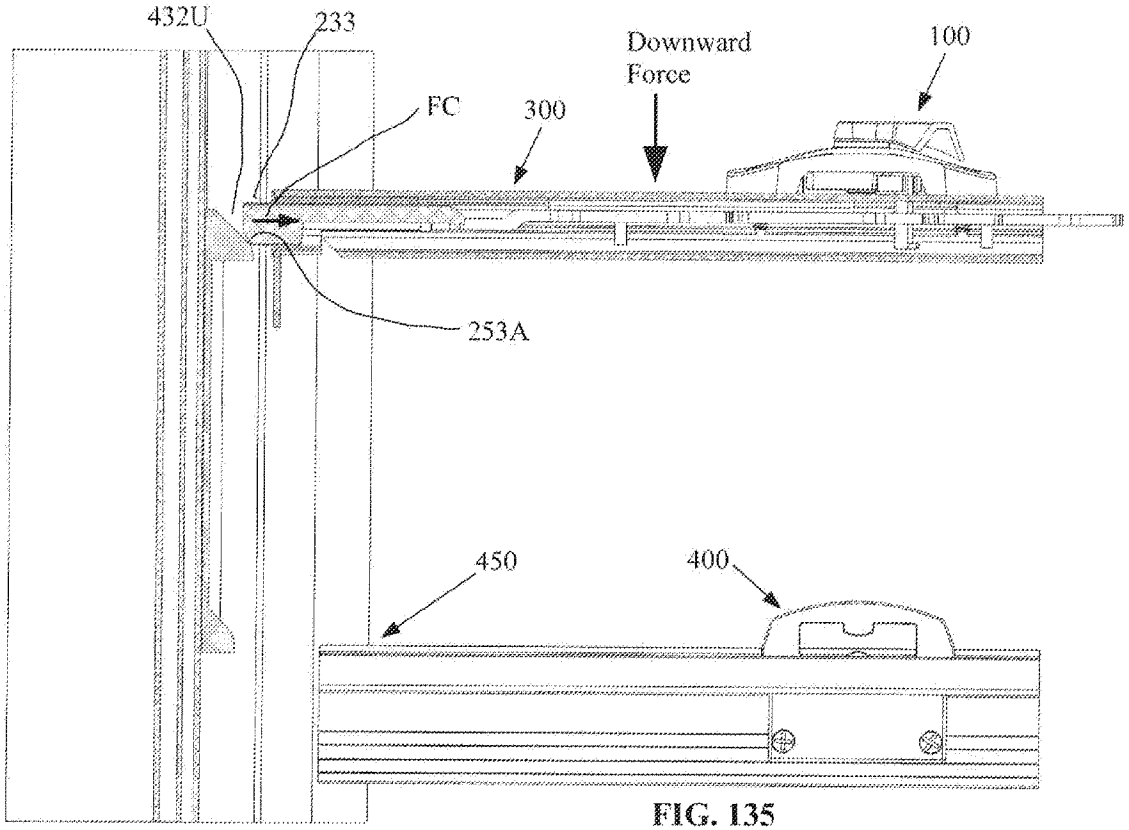

FIG. 135 is the cross-section of FIG. 129, but after the window had been opened beyond the window-limited position of FIG. 127, and with the cam and shaft/handle member moved back into the first retracted position, with the latch member moved back into its corresponding first retracted latch position, and with the angled bottom of the latch member contacting the angled top of the stop.

Figure 136:
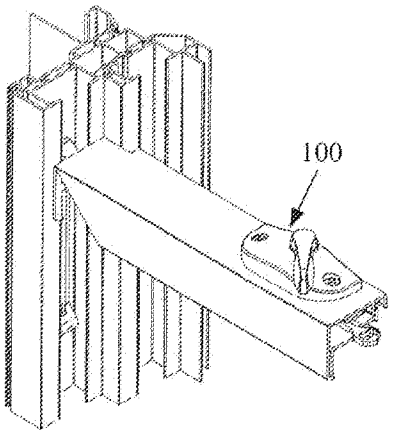

FIG. 136 is a perspective view of the arrangement shown in FIG. 135.

DETAILED DESCRIPTION OF THE INVENTION

Figure 1:
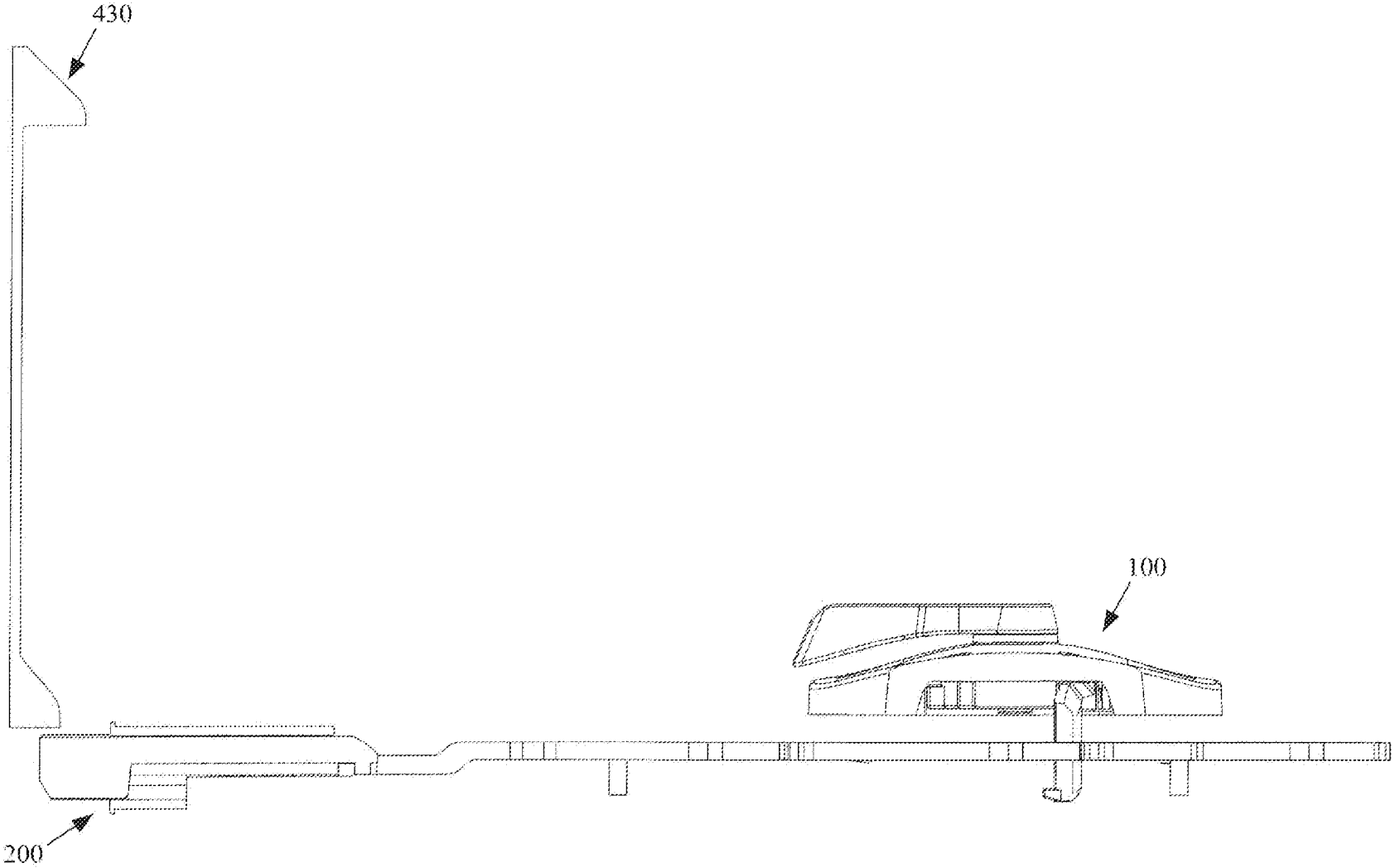
FIG. 1 is a side view of a sash fastener for a slidable sash member, and includes a sash lock assembly, a tilt latch assembly, and a stop member.
Figure 2:
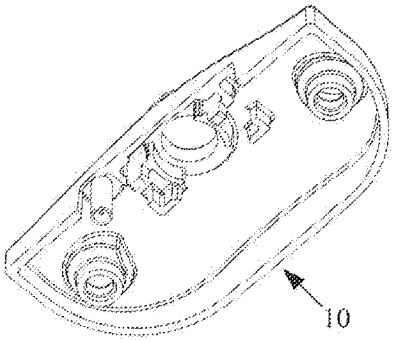
FIG. 2 is a first perspective view showing the interior of a housing that may be used to house the component parts of the sash lock assembly of FIG. 1.
Figure 3:
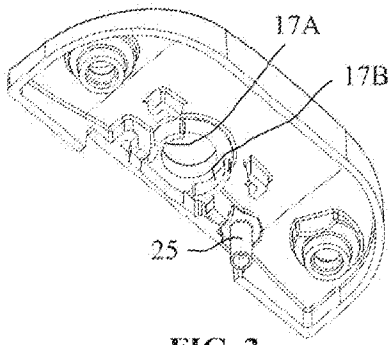
FIG. 3 is a second perspective view showing the interior of the housing of FIG. 2.
Figure 4:
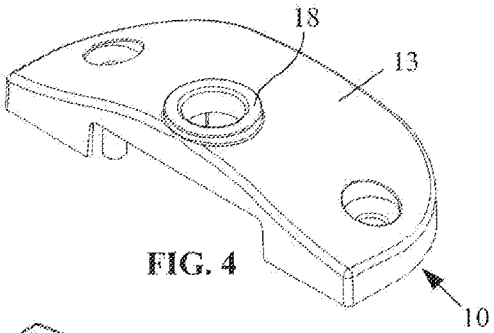
FIG. 4 is a third perspective view showing the front of the exterior of the housing of FIG. 2.
Figure 5:
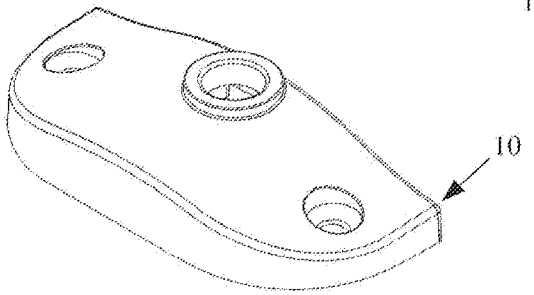
FIG. 5 is a fourth perspective view showing the rear exterior of the housing of FIG. 2.
Figure 7:
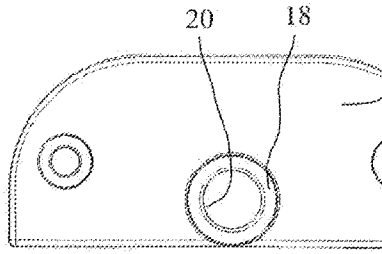
FIG. 7 is a top view of the sash lock housing of FIG. 2.

FIG. 1 shows an embodiment of the Applicant's integrated sash lock/tilt latch fastener, which may be used in conjunction with a sash window that is designed to be slidable and tiltable with respect to a master window frame.

The integrated sash lock/tilt latch fastener of FIG. 1 may include a latch assembly 200, and a sash lock assembly 100, which may be blindly mated to the latch assembly during its installation upon the meeting rail of the sash window. The latch assembly may interact with a stepped stop 430.

Figure 6:
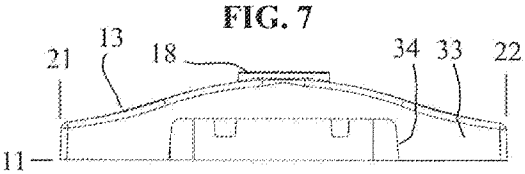
FIG. 6 is a front view of the sash lock housing of FIG. 2.
Figure 9:
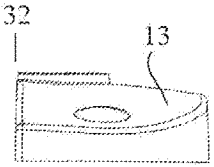
FIG. 9 is a first end view of the sash lock housing of FIG. 2.
Figure 8:
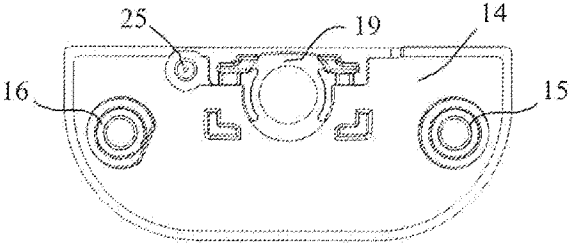
FIG. 8 is a bottom view of the sash lock housing of FIG. 2.
Figure 10:
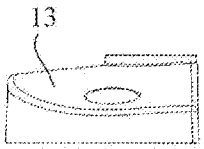
FIG. 10 is a second end view of the sash lock housing of FIG. 2.
Figure 11:
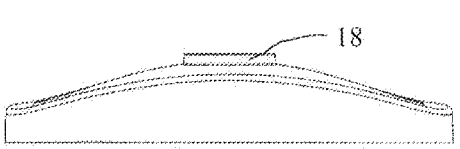
FIG. 11 is a rear view of the sash lock housing of FIG. 2.

Perspective views of the housing 10 of the sash lock assembly 100 are shown in FIGS. 2-5, while corresponding orthogonal views are shown in FIGS. 6-11. The housing 10 is not limited to the shape illustrated within FIGS. 6-11, and could take on many different suitable shapes, including a rectangular shape, an irregular shape, etc. However, the housing 10 may be desirably shaped to have a generally curved outer surface 13, spanning from a first end 21 to second end 22. The curvature of surface 13 may terminate at a generally flat bottom surface 11. The curvature of surface 13 may also transition, as seen in FIG. 9, into a generally flat surface 32, at which a wall 33 may be formed (FIG. 6). The housing 10 may be hollowed out to form an interior surface 14, and the wall 33 may have an opening 34 into the interior cavity of the housing.

Extending outwardly from the interior surface 14 of the housing 10 may be at least one hollow cylindrical protrusion that may be used to secure the sash lock assembly 100 to the sash window. In one embodiment of the housing, two hollow cylindrical protrusions 15 and 16 are used, and each may be configured to respectively receive a screw for mounting of the sash lock 100 to the meeting rail of the sliding sash window.

Extending outwardly from the interior surface 14 of the housing 10 may also be a shaft 25, which may be used for pivotal mounting of a lever arm.

The housing 10 may have a cylindrical boss 18 extending upwardly from the outer surface 13, and may also have a cylindrical boss 19 extending downwardly from the interior surface 14, into the housing cavity. The housing may have a hole 20 through the cylindrical boss 18 and boss 19. The hole 20 may be used for pivotal mounting of a shaft that may extend from a portion of the locking cam, or alternatively, the hole 20 may be used for pivotal mounting of a separate shaft/handle member, to which the locking cam may instead be fixedly secured.

As seen in FIGS. 13-21, a shaft/handle member 40 may have a cylindrical shaft 43, one end of which may have a keyed protrusion 44 extending therefrom, with an orifice therein. The other end of the shaft 43 may have a graspable handle portion 46 that may extend generally orthogonally with respect to the axis of shaft 43. The shaft 43 may be configured to be pivotally received within the hole 20 in the boss 18 of the housing 10. The keyed protrusion 44 may be any suitable cross-sectional shape, and in this example, the keyed protrusion is formed using a rectangular shape.

The locking cam 50, illustrated in FIGS. 22-32, may have a cylindrical hub 53, with a keyed opening 54 that is shaped to match the keyed protrusion 44 of the shaft/handle member 40. Extending laterally away from the hub 53 may be a wall 55, and extending laterally away from the wall 55 may be a curved cam wall 56, which may be used to engage the key of the corresponding keeper, and to draw the sliding sash window in closer proximity to the master window frame (or to the other sash window for a double-hung arrangement). The curved cam wall 56 may have a curved protrusion 56P protruding laterally therefrom, which may be a semi-cylindrical protrusion, with a surface having a radius 56PR. The axis of the semi-cylindrical protrusion 56P may be substantially parallel to the axis of the hub 53.

Protruding away from the hub 53 may be a cylindrical member 57, the axis of which may be generally concentric with the axis of the hub. The cylindrical member 57 may have a first flat 58A formed thereon, and a second flat 58B formed thereon to be clocked 180 degrees away from the first flat 58A. The flats 58A and 58B may co-act with respect to the leaf spring 90 shown in FIG. 12, to operate as a detent mechanism to releasably secure the cam 50 at an extended (locking) position and a third retracted (unlocked) position, which are discussed hereinafter with respect to FIGS. 60 and 63.

Figure 28A:
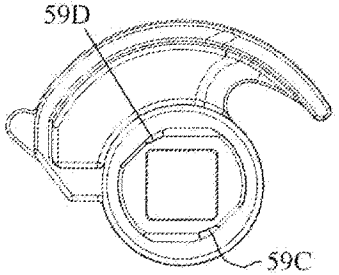
FIG. 28A is the top view of FIG. 28, but showing an additional pair of flats on the hub to co-act with the leaf spring of FIG. 12 to serve as a detent at an additional location.
Figure 28:
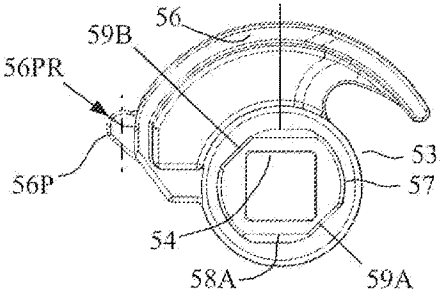
FIG. 28 is a top view of the locking cam of FIG. 22.
Figure 26:
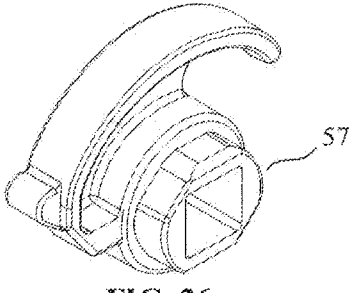
FIG. 26 is a fifth perspective view of the cam shown in FIG. 22.
Figure 30:
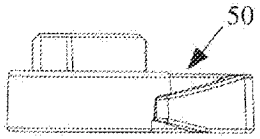
FIG. 30 is a first end view of the locking cam of FIG. 22.
Figure 27:
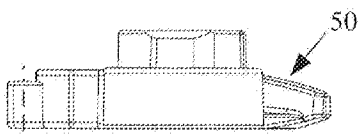
FIG. 27 is a side view of the locking cam of FIG. 22.
Figure 31:
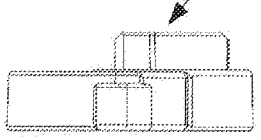
FIG. 31 is a second end view of the locking cam of FIG. 22.
Figure 32:
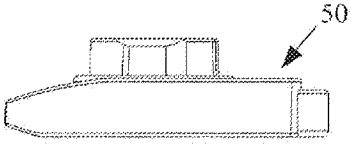
FIG. 32 is a second side view of the locking cam of FIG. 22.
Figure 29:
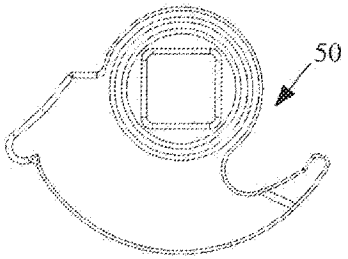
FIG. 29 is a bottom view of the locking cam of FIG. 22.
Figure 37:
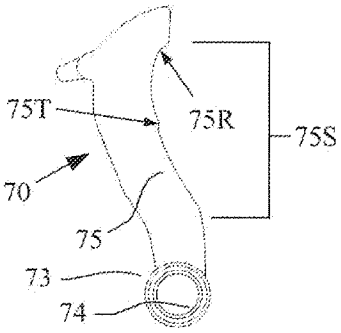
FIG. 37 is a top view of the lever arm of FIG. 33.
Figure 36:
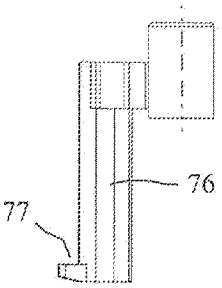
FIG. 36 is a first side view of the lever arm of FIG. 33.
Figure 38:
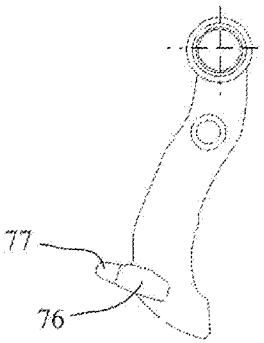
FIG. 38 is a bottom view of the lever arm of FIG. 33.
Figure 39:
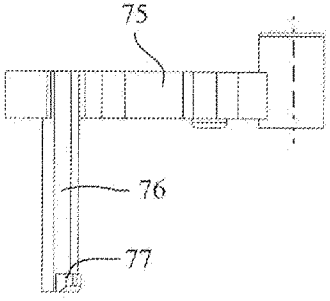
FIG. 39 is a front view of the lever arm of FIG. 33.
Figure 37A:
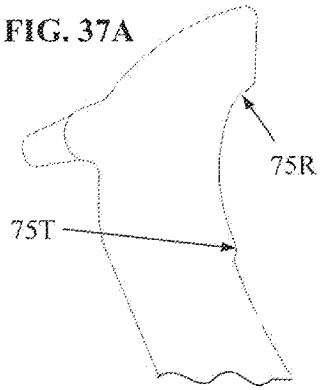
FIG. 37A is an enlarged top view of the lever arm of FIG. 33.
Figure 40:
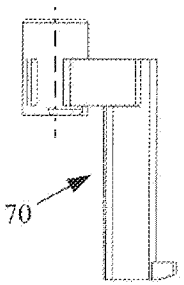
FIG. 40 is a second side view of the lever arm of FIG. 33.
Figure 33:
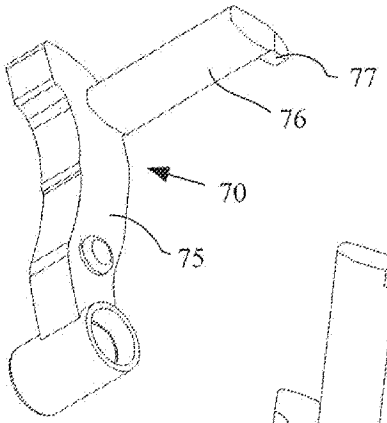
FIG. 33 is a first perspective view of the lever arm of the sash lock assembly of FIG. 1.
Figure 34:
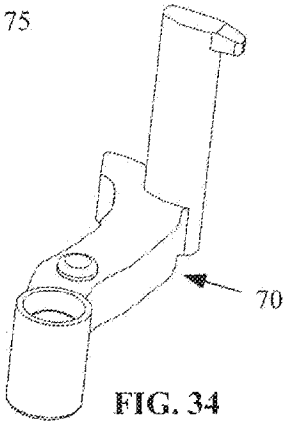
FIG. 34 is a second perspective view of the lever arm of FIG. 33.
Figure 35:
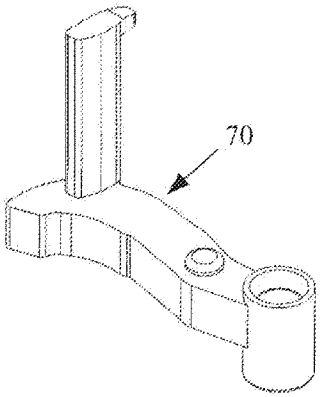
FIG. 35 is a third perspective view of the lever arm of FIG. 33.

The cylindrical member 57A may also have a third flat 59A formed thereon, as seen in FIG. 28, at a position that is clocked roughly 135 degrees from the first flat 58A. The flat 59A may also co-act with respect to the leaf spring 90 to operate as a detent mechanism to releasably secure the cam 50 at another sash unlocked position, termed herein, with respect to the operation of the sash lock and sash window, as a first retracted (unlock) position. For greater stability of the cam in being releasably retained at this unlocked position, a fourth flat 59B may be positioned on the cylindrical member 57 at a position that is clocked roughly 180 degrees from the third flat 59A, which may releasably engage a second leaf spring. Note that the flats could be formed on the cylindrical hub 53, instead of on the protruding cylindrical member 57.

As seen for the alternate embodiment of the cam in FIG. 28A, the cylindrical member 57A may also have a fifth flat 59C formed thereon, at a position that is clocked roughly 160 degrees from the first flat 58A. The flat 59C may also co-act with respect to the leaf spring 90 to operate as a detent mechanism to releasably secure the cam 50 at yet another sash unlocked position, termed herein as a second retracted (unlock) position. A sixth flat 59D may be positioned on the cylindrical member 57 at a position that is clocked roughly 180 degrees from the fifth flat 59C, and which may releasably engage the second leaf spring.

Interaction between the sash lock assembly 100, once installed upon the meeting rail of the sliding sash window, and the latch assembly 200, may be through the use of a lever arm 70 that may be pivotally mounted within the cavity of the housing 10. The lever arm 70 is shown within FIGS. 33-40. Lever arm 70 may include a hub 73, with a mounting hole 74 therein. Extending laterally away from the axis of the hub 73 may be an arm 75, which may have a sculpted surface 75S (a follower portion), and which may include a small radiused step 75T that may serve as a detent. The sculpted surface 75S may include a radiused concave feature 75R which is discussed hereinafter. The radiused feature 75R may be formed with a radius being substantially equal to, or slightly larger than, the radius 56PR for the protrusion 75P on cam 50, for engagement therebetween. The sculpted surface 75S is shaped to be selectively driven by rotation of the semi-cylindrical protrusion 56P of the locking cam 50, as discussed hereinafter. The arm 75 may transition into a post 76 that may be generally orthogonal to the arm 75, and may be generally parallel to the axis of the hub 73. A protrusion 77 may protrude from the post 76.

Figure 12:
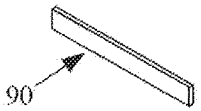
FIG. 12 is a perspective view of a leaf spring used in the sash lock assembly of FIG. 1
Figure 13:
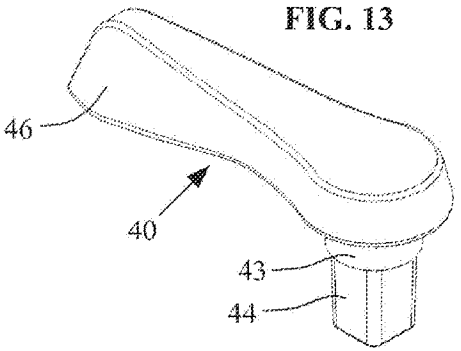
FIG. 13 is a first perspective view of the shaft/handle member of the sash lock assembly of FIG. 1.
Figure 14:
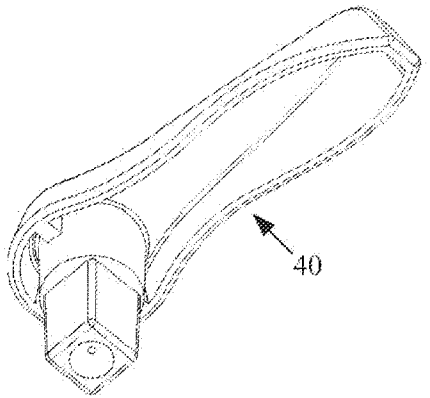
FIG. 14 is a second perspective view of the shaft/handle member shown in FIG. 13.
Figure 15:
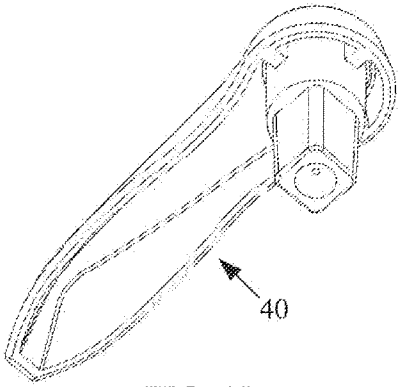
FIG. 15 is a third perspective view of the shaft/handle member shown in FIG. 13.
Figure 17:
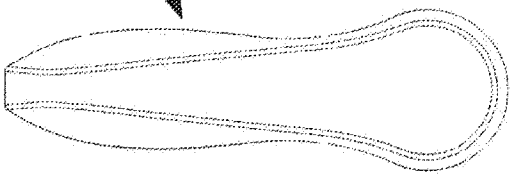
FIG. 17 is a top view of the shaft/handle member of FIG. 13.
Figure 16:
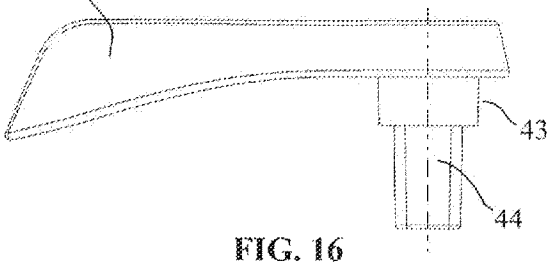
FIG. 16 is a side view of the shaft/handle member of FIG. 13.
Figure 19:
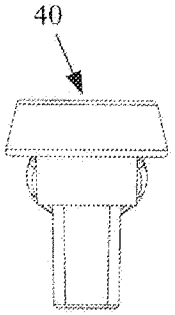
FIG. 19 is a first end view of the shaft/handle member of FIG. 13.
Figure 18:
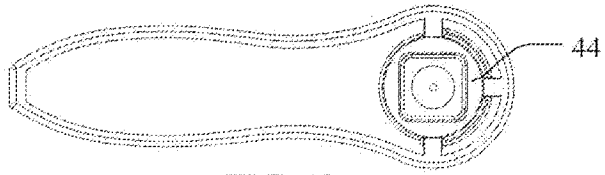
FIG. 18 is a bottom view of the shaft handle member of FIG. 13.
Figure 20:
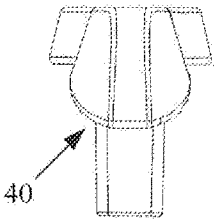
FIG. 20 is a second end view of the shaft/handle member of FIG. 13.
Figure 21:
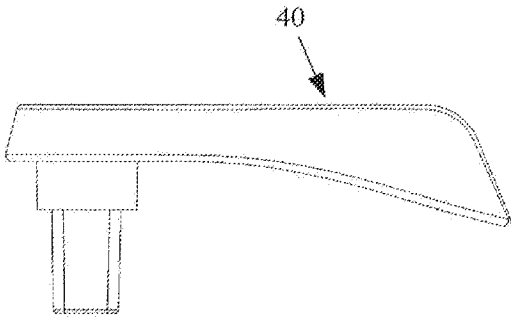
FIG. 21 is a second side view of the shaft/handle member of FIG. 13.
Figure 22:
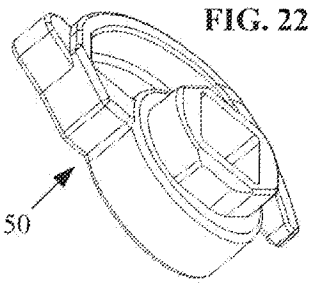
FIG. 22 is a first perspective view of the cam of the sash lock assembly of FIG. 1.
Figure 23:
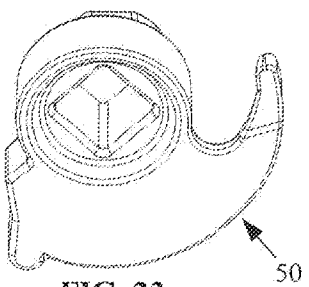
FIG. 23 is a second perspective view of the cam shown in FIG. 22.
Figure 24:
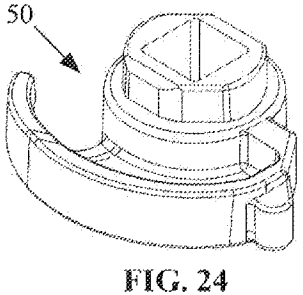
FIG. 24 is a third perspective view of the cam shown in FIG. 22.
Figure 25:
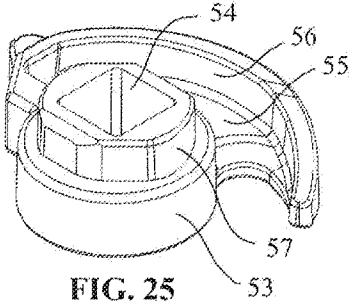
FIG. 25 is a fourth perspective view of the cam shown in FIG. 22.
Figure 41:
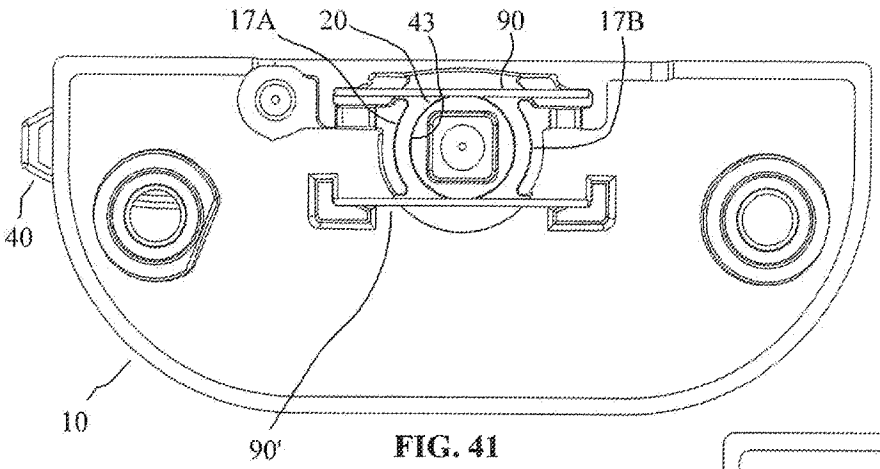
FIG. 41 is a bottom view of the housing of the latch assembly of FIG. 1, shown with two leaf springs and the shaft/handle member installed therein.

Initial assembly of sash lock assembly 100 is shown in FIG. 41. The leaf spring 90, which may be a generally flat elongated flexible member, as seen in FIG. 12, may be installed into the housing interior. The ends of leaf spring 90 may be fixedly received within a pair of corresponding recesses in the housing, using a friction fit, or using adhesive, or mechanical fasteners, etc. As mentioned above, a second leaf spring 90' may be used, and may similarly be secured within the housing cavity, to be at a distance away from the first leaf spring 90 that is roughly the same as the distance between the pair of flats 58A and 58B, which may be roughly the same as the distance between the pair of flats 59A and 59B, and between flats 59C and 59D. The cylindrical shaft 43 of the shaft/handle member 40 may then be pivotally received in hole 20 of housing 10.

Figure 42:
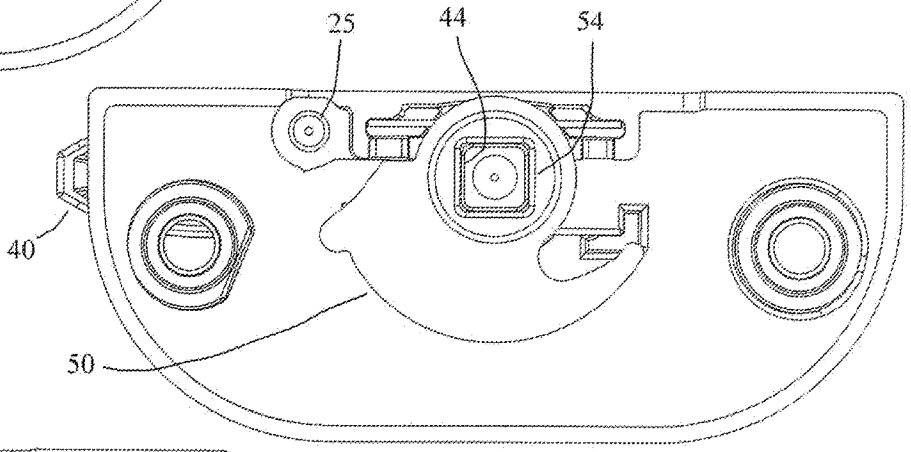
FIG. 42 is the bottom view of FIG. 41, but shown with the cam fixedly secured to the shaft/handle member.

As seen in FIG. 42, the locking cam 50 may then be joined to the shaft/handle member 40, with the keyed protrusion 44 of the shaft member 40 being received within the keyed opening 54 of locking cam 50, and being secured thereat using a friction fit, adhesive, mechanical fasteners, or by being welded thereto, or by using any combination of suitable means of securing two parts together. Note that additional pivotal support for the cam 50 may be provided by the curved housing walls 17A and 17B (FIG. 2A and FIG. 41) supporting the hub 53 of the cam therebetween.

Figure 43:
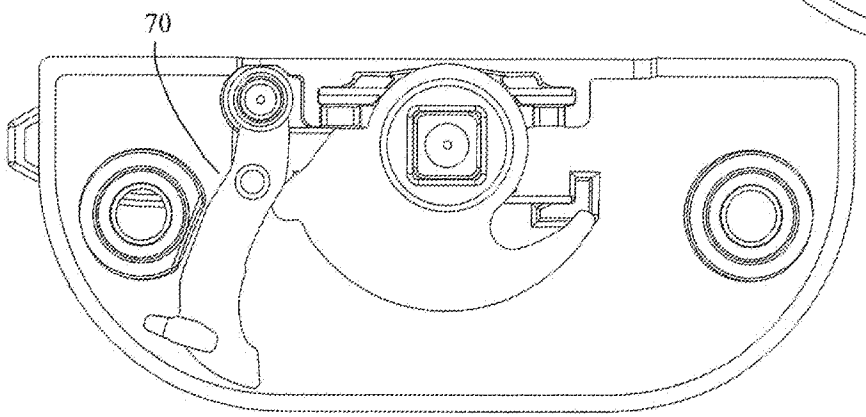
FIG. 43 is the bottom view of FIG. 42, but shown with the lever arm pivotally installed therein.
Figure 44:
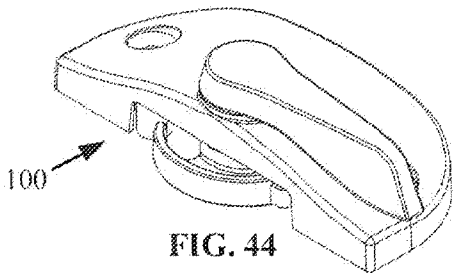
FIG. 44 is a first perspective view of the lock assembly of FIG. 43, shown with the cam in the extended position (i.e., shaft/handle at zero degrees of rotation).
Figure 45:
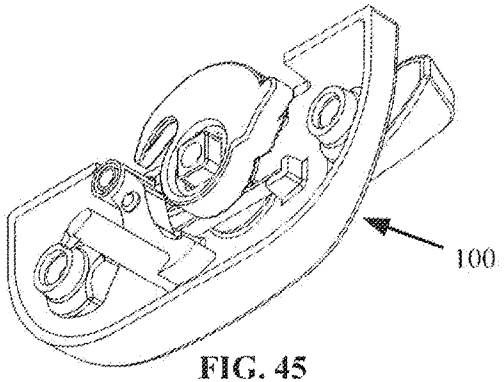
FIG. 45 is a second perspective view of the lock assembly of FIG. 44.
Figure 47:
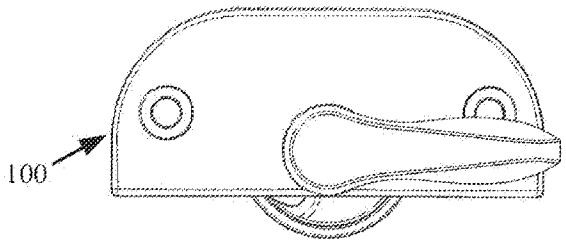
FIG. 47 is a top view of the lock assembly of FIG. 44.
Figure 49:
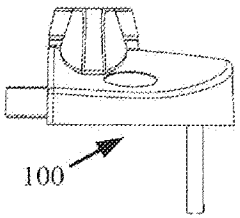
FIG. 49 is a first end view of the lock assembly of FIG. 44.
Figure 46:
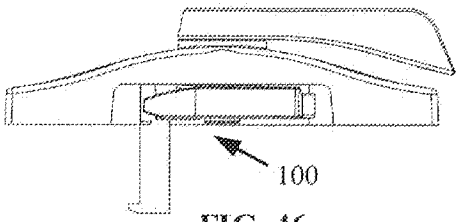
FIG. 46 is a front view of the lock assembly of FIG. 44.
Figure 48:
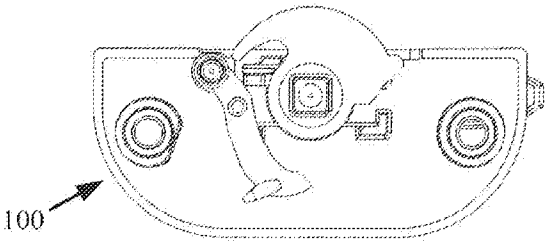
FIG. 48 is a bottom view of the lock assembly of FIG. 44.
Figure 50:
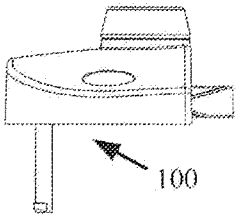
FIG. 50 is a second end view of the lock assembly of FIG. 44.
Figure 51:
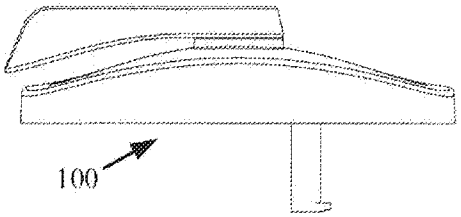
FIG. 51 is a rear view of the lock assembly of FIG. 44.
Figure 52:
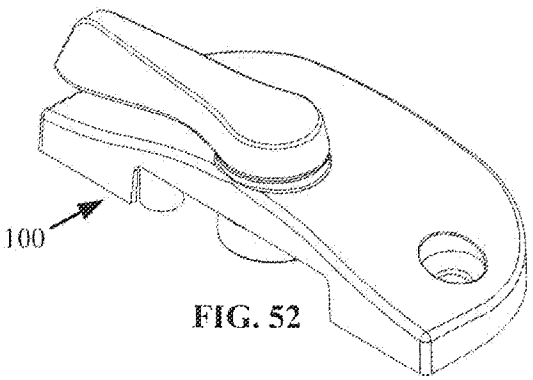
FIG. 52 is a first perspective view of the lock assembly of FIG. 43, shown with the cam in the fully retracted position (i.e., shaft/handle at 180 degrees of rotation).
Figure 53:
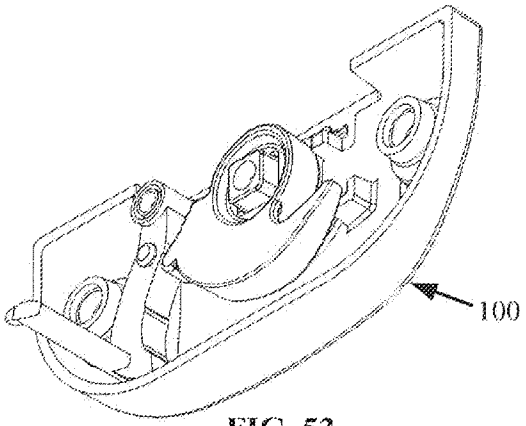
FIG. 53 is a second perspective view of the lock assembly of FIG. 52.
Figure 55:
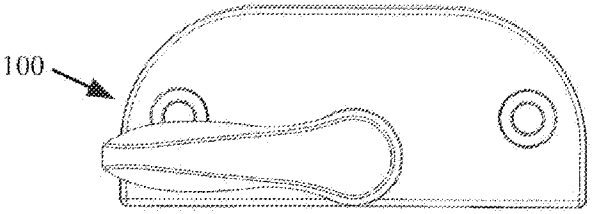
FIG. 55 is a top view of the lock assembly of FIG. 52.
Figure 57:
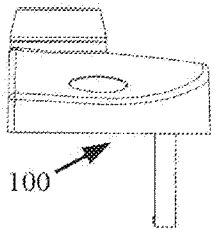
FIG. 57 is a first end view of the lock assembly of FIG. 52.
Figure 54:
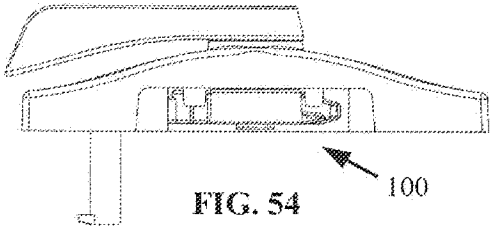
FIG. 54 is a front view of the lock assembly of FIG. 52.
Figure 56:
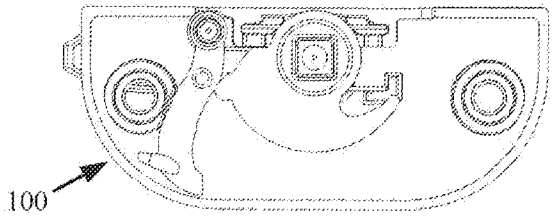
FIG. 56 is a bottom view of the lock assembly of FIG. 52.
Figure 58:
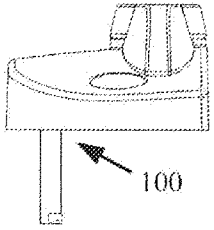
FIG. 58 is a second end view of the lock assembly of FIG. 52.
Figure 59:
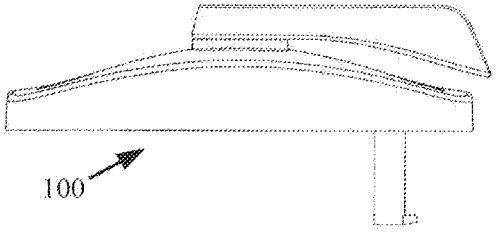
FIG. 59 is a rear view of the lock assembly of FIG. 52.

Next, as seen in FIGS. 42 and 43, the hole 74 of the hub 73 of the lever arm 70 may be pivotally received upon the shaft 25 that may protrude out from the interior surface 14 of the housing. To pivotally secure the lever arm 70 thereto, the end of the shaft 25 may be bucked like a rivet, to form a head to prevent the lever arm from slipping off of the post. Alternatively, a screw or other mechanical fastener may be used for pivotally securing the hub 73 of the lever arm 70 to the shaft 25 of the housing 10.

FIGS. 44-51 show various views of the sash lock assembly with the cam in the extended (lock) position.

FIGS. 52-59 show various views of the sash lock assembly with the cam in the third retracted (unlock) position.

FIGS. 60-63 show four key positions that may be occupied by the components of the assembled sash lock 100.

Figure 60:
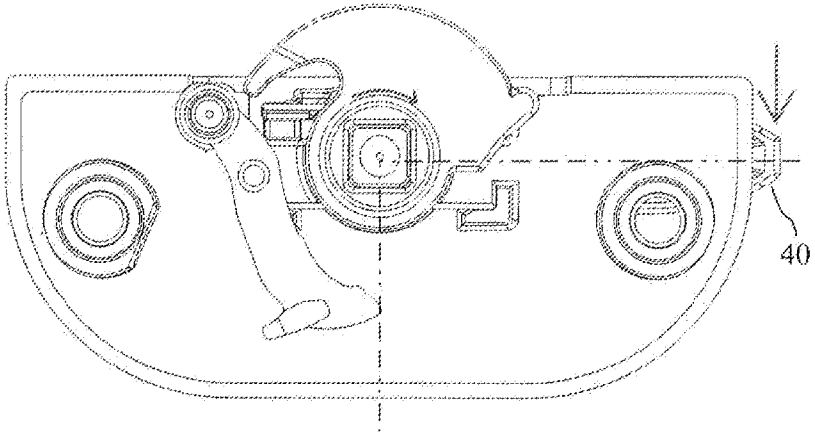
FIG. 60 is the bottom view of the sash lock of FIG. 48 with cam in the extended position (i.e., shaft/handle at zero degrees of rotation), but is shown enlarged.

FIG. 60 shows the sash lock assembly 100 in the extended locking position, where the curved wall 56 of cam 50 protrudes out from the housing 10, and may engage the key (or "tooth") of a keeper to secure the sliding sash window from sliding within the track of the master window frame, as discussed hereinafter. The lever arm 70 shown therein, is unaffected by the cam 50 in this position, and the lever arm is biased into the position shown by the interconnection with the biased latch member of the latch assembly.

Figure 61:
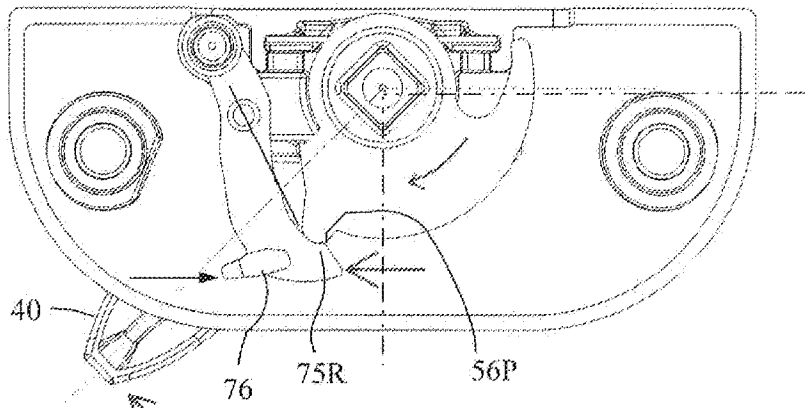
FIG. 61 is the bottom view of FIG. 60, but shown with the cam having been moved into the first retracted position (i.e., shaft/handle at 135 degrees of rotation), and with the protrusion on the cam having contacted and actuated the follower portion of the lever arm.
Figure 64:
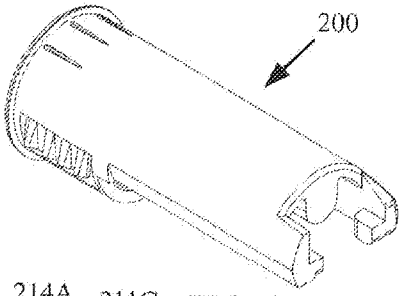
FIG. 64 is a first perspective view of a housing used to house the component parts of the latch assembly of FIG. 1.
Figure 65:
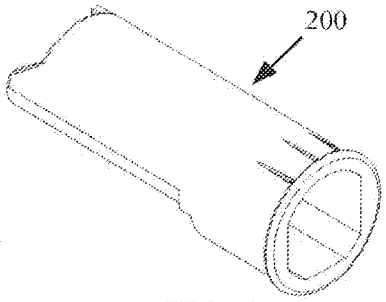
FIG. 65 is a second perspective view of the housing shown in FIG. 64.
Figure 66:
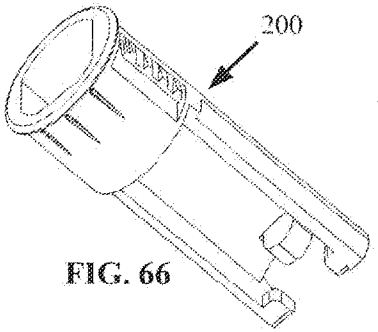
FIG. 66 is a third perspective view of the housing shown in FIG. 64.
Figure 67:
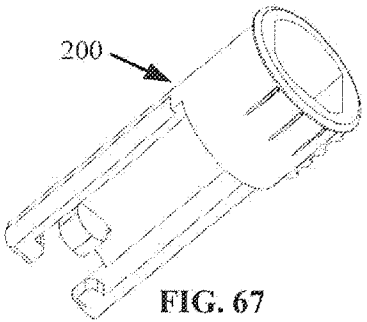
FIG. 67 is a fourth perspective view of the housing shown in FIG. 64.
Figure 68:
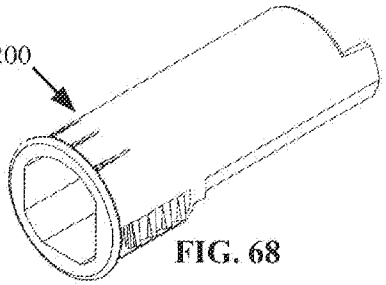
FIG. 68 is a fifth perspective view of the housing shown in FIG. 64.

FIG. 61 shows the sash lock assembly 100 in the first retracted (unlocked) position, where the shaft/handle member 40 has been rotated 135 degrees from the extended locking position, for the curved wall 56 of cam 50 to disengage from the keeper and be retracted within the cavity of the housing 10, to permit the sash window to slide in the master window frame. During the final portion of the 135 degrees of rotation for the cam to reach the first retracted unlock position, the semi-cylindrical protrusion 56P of the locking cam 50 may contact the lever arm 70 and cause it to similarly rotate, but only a small amount. After the small amount of co-rotation of arm 70, the radiused surface 56$P_R$ of protrusion 75P on cam 50 may nest within the radiused feature 75R of the arm, for releasable engagement therebetween. With this arrangement of lever arm 70 and cam 50 at the first retracted position (for the fastener to serve as a window vent stop), if a force is applied to the post 76 of the arm by the latch, counter-rotation of the arm about its hub would be reacted by its engagement with the cam, and be further reacted, in part, through the pivotal mounting of the cam.

Figure 62:
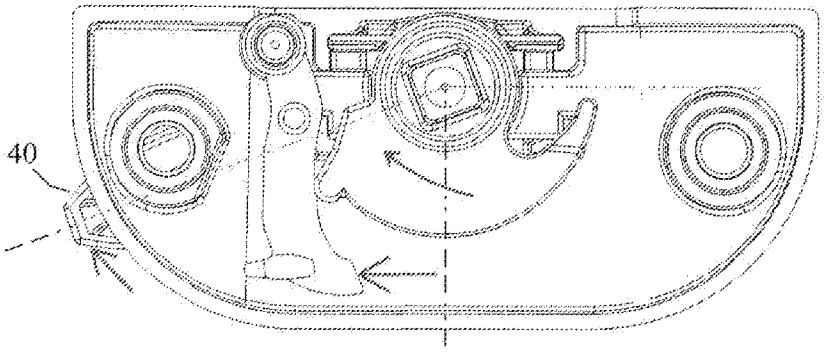
FIG. 62 is the bottom view of FIG. 61, but shown with the cam having been moved into the second retracted position (i.e., shaft/handle at 160 degrees of rotation), and with the protrusion on the cam having further driven the follower portion of the lever arm.

FIG. 62 shows the sash lock assembly 100 in the second retracted (unlocked) position, where the shaft/handle member 40 has been rotated an additional 25 degrees from the first retracted position (i.e., is rotated 160 degrees from the locking position). During those 25 degrees of rotation for the cam to reach the second retracted position, the semi-cylindrical protrusion 56P of the locking cam 50 may disengage from its position with respect to the radiused feature 75R (FIG. 61) of the arm, at which the detent mechanism provides a restraining force that inhibits motion away from that position, and drive the lever arm 70 to further co-rotate, after which the semi-cylindrical protrusion 56P of the locking cam may rest against the step 75T to provide a tactile indication of such positioning.

Figure 63:
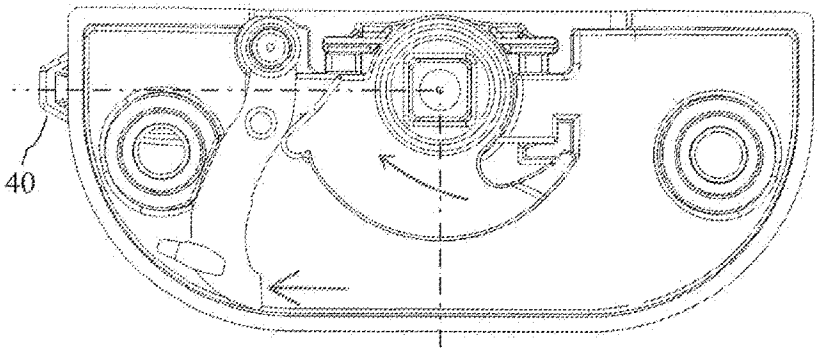
FIG. 63 is the bottom view of FIG. 62, but shown with the cam having been moved into the third retracted position (i.e., shaft/handle at 180 degrees of rotation), and with the protrusion on the cam having correspondingly driven the follower portion of the lever arm.

FIG. 63 shows the sash lock assembly 100 in the third retracted (unlock) position, where the shaft/handle member 40 has been rotated an additional 20 degrees past the second retracted position (i.e., is rotated 180 degrees from the locking position). During those 20 degrees of rotation for the cam to reach the third retracted position, the semi-cylindrical protrusion 56P of the locking cam 50 may pass over the step 75T (FIG. 62), and drive the lever arm 70 to further co-rotate. (Note that the herein described 135 degree, 160 degree, and 180 degree rotational amounts are merely exemplary, and the fastener may be constructed so that other rotational amounts to reach those key positions may alternatively be used).

The clocking of the flat 58A and flat 58B on the cylindrical member 57 on the hub 53 of locking cam 50 may respectively contact and be flush with the leaf springs 90 and 90', to releasably restrain the locking cam 50 from rotating out of the extended locking position and the third retracted unlock position, without being deliberately moved therefrom.

Also, the clocking of the flat 59A and flat 59B of the cylindrical member 57 on the hub 53 of locking cam 50 may be respectively engaged by the flexible leaf springs 90 and 90' when the cam is at the first retracted (unlocked) position. (Note, to increase flexibility of the leaf springs 90 and 90', only one end of each spring may be fixedly mounted in the housing, or alternatively, both ends may be slidably mounted therein, to easily permit lateral deflection of the leaf springs, but without permitting them to become loosened or disconnected from proper positioning within the housing adjacent to the locking cam). This contact of the flats of the cam with the leaf spring may serve to releasably restrain the locking cam 50 from rotating out of the first retracted (unlocked) position, until being deliberately moved therefrom. Note that since the angle at which the flats 58A/58B were clocked from the flats 59A/59B was approximately 135 degrees, the shaft/handle 40 will need to rotate approximately 135 degrees to actuate the sash lock assembly 100 from the extended lock position to the first retracted (unlock) position. This is shown by the movement of the handle portion 46 of the shaft/handle 40 in both figures. As noted above, angular displacements other than 135 degrees are also possible, as long as the rotational movement is sufficient to move the curved wall 56 of cam 50 far enough away from the keeper to permit sliding movement of the sash window, and although it may be desirable, the cam need not even be fully retracted within the housing 10 at the first retraced unlock position.

The shaft/handle 40 and cam 50 may also be releasably secured at the second retracted (unlocked) position using the same detent mechanism, where the leaf springs 90 and 90' engage the flats 59C and 59D on the hub 53 of locking cam 50, where those flats may be utilized.

The shaft/handle 40 and cam 50 may furthermore be releasably secured at the third retracted position using the same detent mechanism, where the leaf springs 90 and 90' once again engage the flats 58A and 58B (i.e., after having been rotation 180 degrees).

The above noted interconnection between the sash lock assembly 100 and the latch assembly 200 may be through the use of the following latch assembly configuration.

Figure 70:
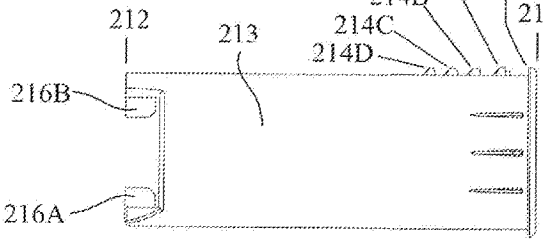
FIG. 70 is a top view of the latch housing of FIG. 64.
Figure 72:
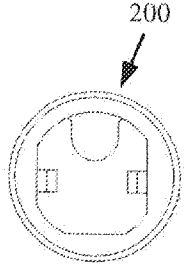
FIG. 72 is a first end view of the latch housing of FIG. 64.
Figure 69:
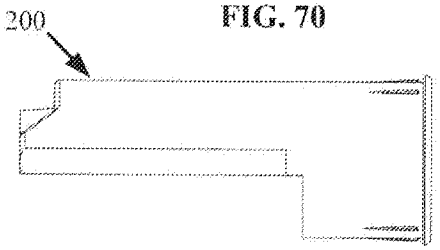
FIG. 69 is a first side view of the latch housing of FIG. 64.
Figure 71:
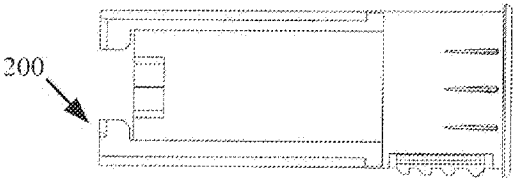
FIG. 71 is a bottom view of the latch housing of FIG. 64.
Figure 73:
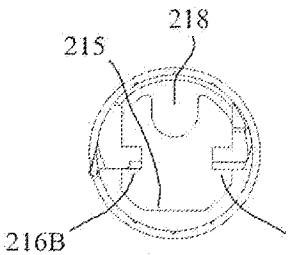
FIG. 73 is a second end view of the latch housing of FIG. 64.
Figure 74:
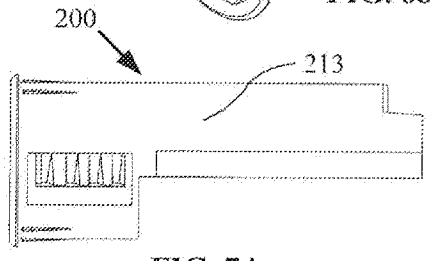
FIG. 74 is a second side view of the latch housing of FIG. 64.
Figure 75:
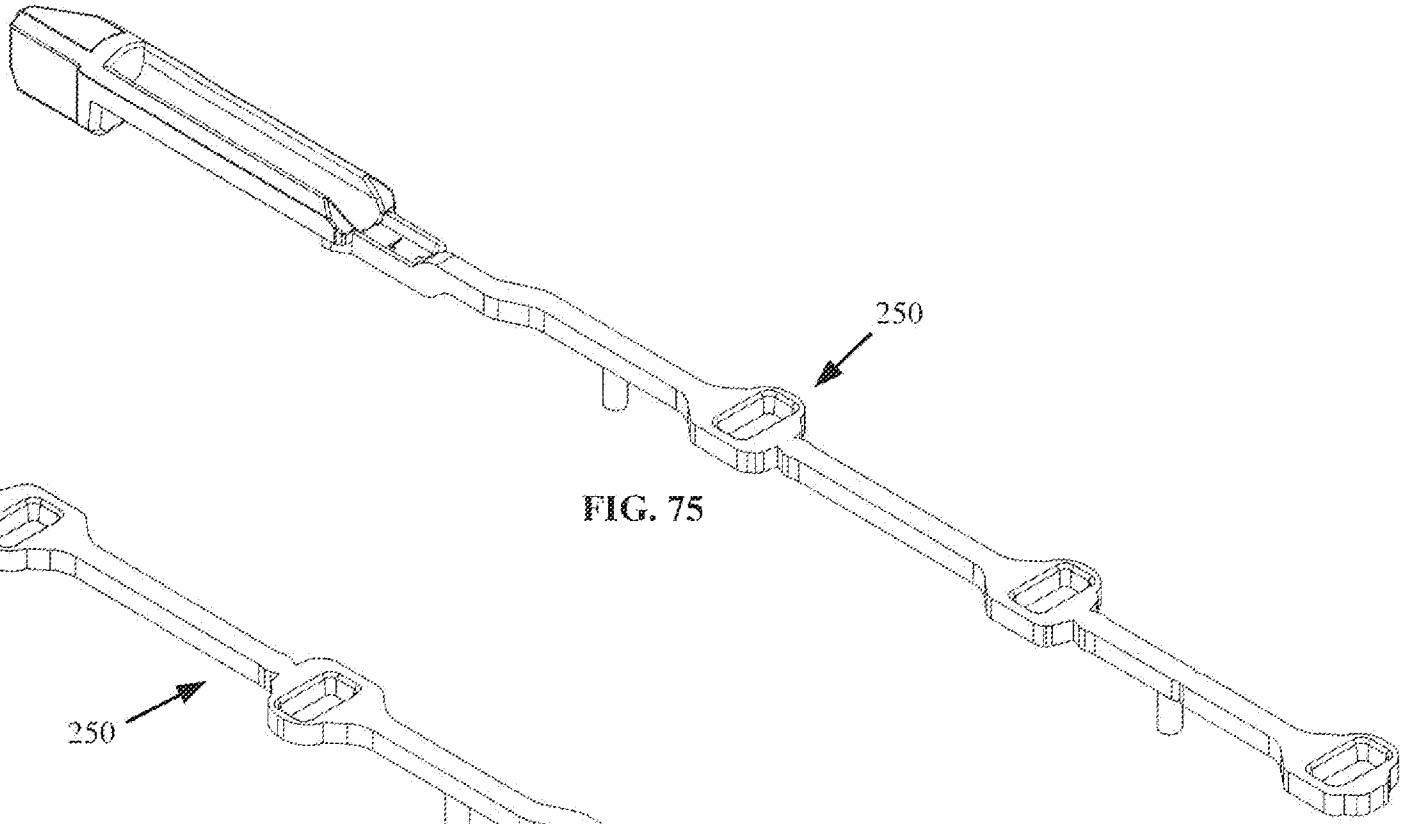
FIG. 75 is a first perspective view of a latch member used in the latch assembly of FIG. 1.
Figure 76:
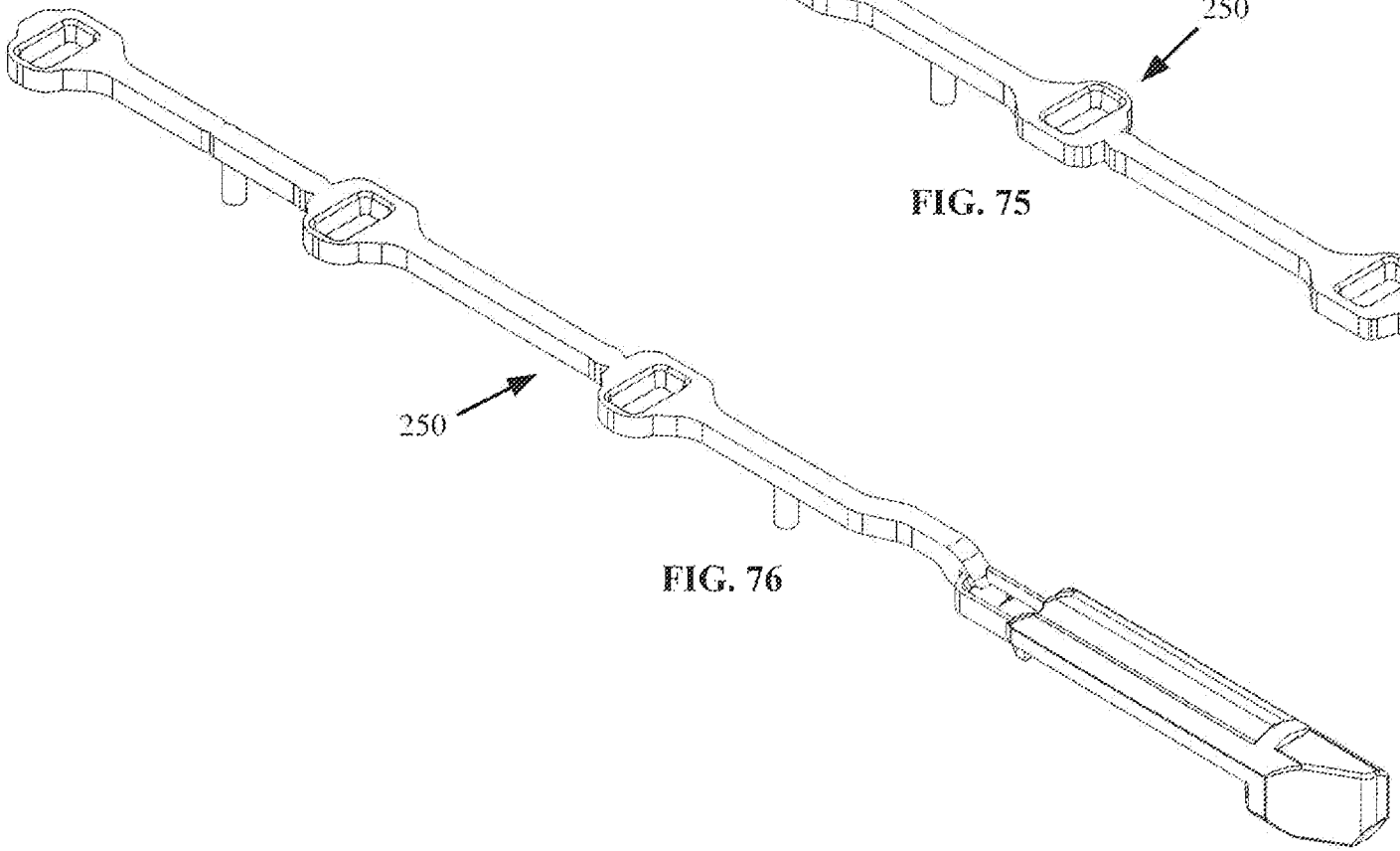
FIG. 76 is a second perspective view of the latch member shown in FIG. 75.
Figure 77:
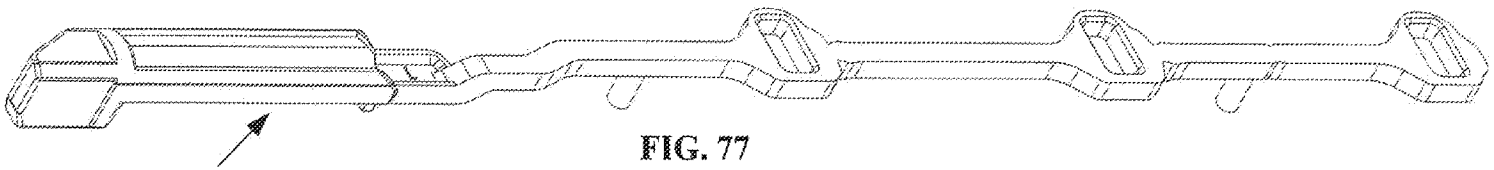
FIG. 77 is a third perspective view of the latch member shown in FIG. 75.
Figure 78:
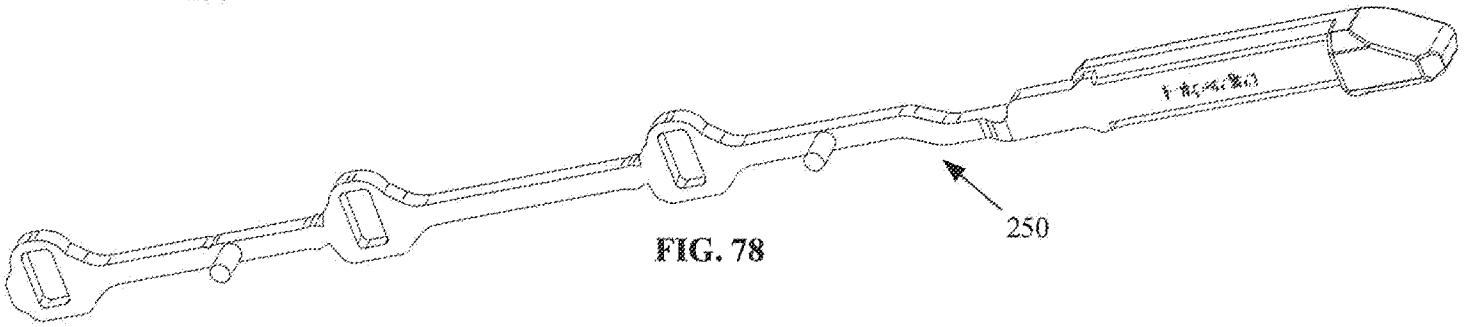
FIG. 78 is a fourth perspective view of the latch member shown in FIG. 75.

The latch assembly 200 may include a latch housing 210, shown in FIGS. 64 to 74, which may have a simple exterior surface (e.g., generally cylindrical), the complement of which may be easily formed (e.g., bored) into the sliding sash window frame, to permit ease of its installation therein. However, the housing 210 is not limited to the shape illustrated within those figures, and could take on many different appropriate shapes, including an elongated rectangular shape. However, at least a portion of the housing 210 may be desirably shaped to have a cylindrical outer surface 213, which may span from a first end 211 to second end 212 (FIG. 70). At the first end 211 of the housing 210, the cylindrical outer surface 213 may transition into a protruding lip 211C. A portion of the cylindrical outer surface 213 may also have a series of successive teeth (e.g., 214A, 214B, 214C, 214D, etc.) formed thereon, for securing of the housing within the hole that is bored/formed in the window rail. The housing 210 may be hollowed out to form an interior surface 215. Protruding into the interior surface 215 may be one stop 216A or a pair of stops (e.g., 216A and 216B). A wall 218 may protrude inward to obstruct a portion of the hollowed out interior between the first end 211 and the second end 212. The housing 210 being so formed may slidably receive a latch member 250 therein.

Figure 79:
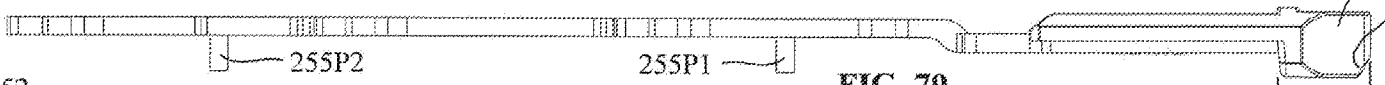
FIG. 79 is a first side view of the latch member of FIG. 75.

Perspective views of the latch member 250 are shown in FIGS. 75-78, while corresponding orthogonal views are shown in FIGS. 79-83. The latch member 250 may extend from first end 251 to second end 252, and may include a tongue 253 that may begin at the first end of the latch member and extend only part way to its second end. The tongue 253 may have a generally flat engagement surface 254E that may engage the track of the master window frame to prevent outward tilting of the sliding sash window, and it may also have an angled surface 254A that tapers toward the engagement surface 254E to create an apex. The angled surface 254A may be used, upon contact with the master window frame, to oppose biasing of the latch member and assist in driving it into a retracted position, until the tongue enters the track of the master window frame, and is biased into its extended position to have the engagement surface 254E re-engage the track. The bottom of tongue 253 may have an angled surface 253A formed thereon (FIG. 79). The tongue 253 may also have one stop 266A protruding therefrom (FIG. 81) or a pair of stops (e.g., 266A and 266B). Extending away from the tongue 253 may be an elongated beam 255 that may be flexible.

Figure 80:
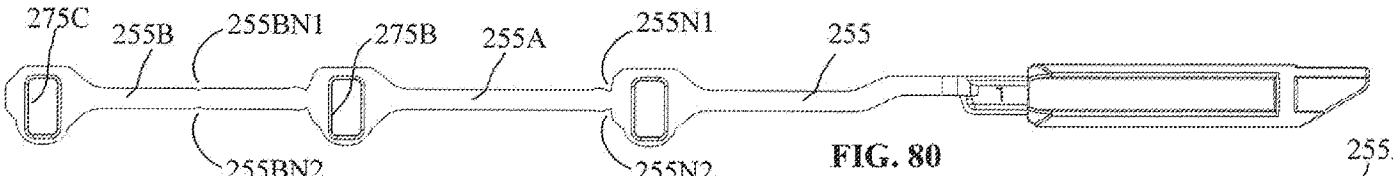
FIG. 80 is a top view of the latch member of FIG. 75.
Figure 83:
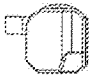
FIG. 83 is an end view of the latch member of FIG. 75.
Figure 81:
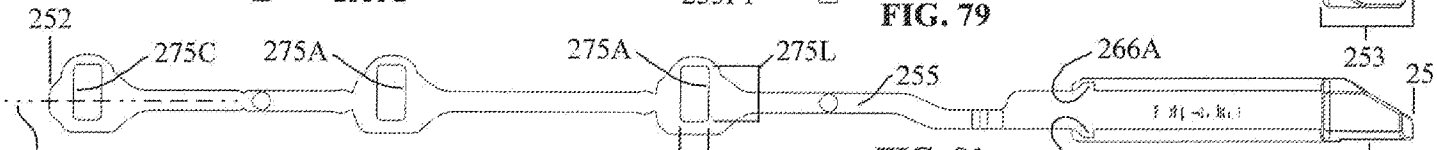
FIG. 81 is a bottom view of the latch member of FIG. 75.
Figure 82:
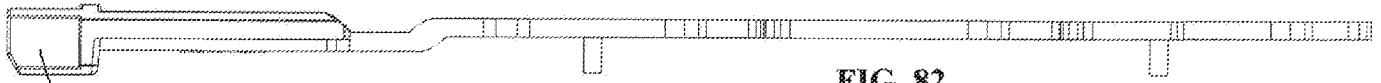
FIG. 82 is a second side view of the latch member of FIG. 75.

The generally slender beam 255 may transition and widen to form peripheral walls about an opening 275A, the size of which may depend upon the cross-sectional shape of the post 76 of lever arm 70 of the lock assembly 100, to provide for engagement of the post with the latch assembly. The opening 275A may be an elongated shape, which may, for example, be generally rectangular-shaped, as shown in FIGS. 80 and 81. The elongated opening may be oriented so that the longer direction of the opening is substantially perpendicular to the axis 255X of the beam 255. The rectangular opening 275A may therefore have a length 275L extending substantially normal to the axial direction 255X of the beam, and a width 275W extending substantially parallel to the axial direction of the beam. The internal corners of the rectangular opening 275 may be radiused.

Extending away from the far end of the peripheral walls formed about opening 275A may be a secondary beam 255A that may be formed substantially the same as beam 255, and the distal end of which may similarly widen to form peripheral walls about an opening 275B that may be constructed the same as opening 275A. The connection of the beam 255A with the peripheral walls about opening 275A may include a first notch 255N1 on a first side of the beam and a second notch 255N1 on a second side of the beam, to produce an area that may be weakened. The weakened area may be used to sever the secondary beam 255A from the peripheral walls associated with beam 255, where it is necessary to use the first opening 275A for receiving the post 76 of the lever arm 70 of the sash lock 100, with respect to mounting upon a meeting mail of a window of a particular size. A third beam 255B with peripheral walls about an opening 275C may be similarly formed. An additional pair of notches (255BN1 and 255BN2) may be formed in its central region, to permit severing of the most distal portion of the beam, being just beyond the cylindrical protrusion 255P2.

Biasing of the slidable latch member 250 relative to the housing 210 may be through the use of a suitably arranged tension spring, or by using a compression spring. To simplify the presentation, the figures herein only depict an embodiment where a compression spring is utilized.

Figure 84:
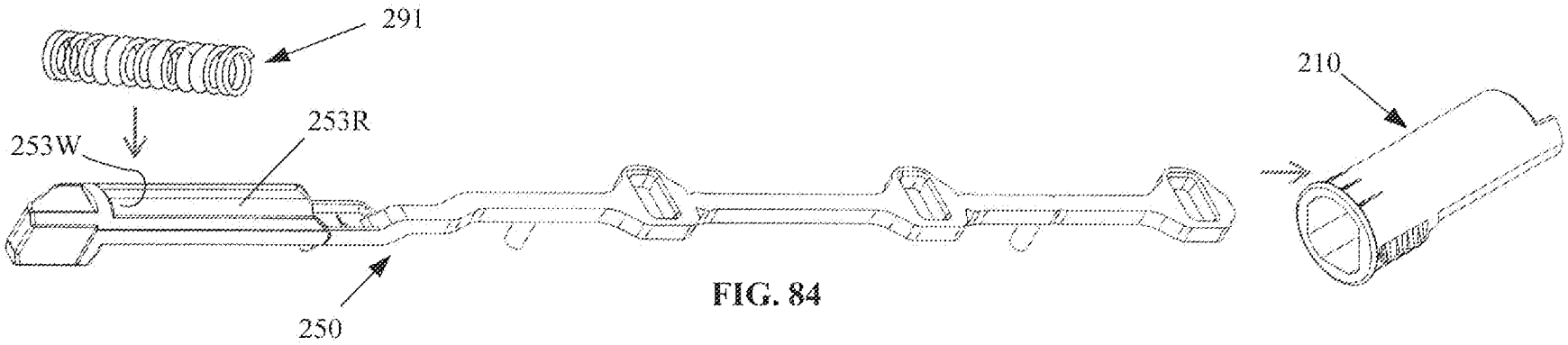
FIG. 84 is an exploded view showing the latch member of FIG. 77, the latch housing of FIG. 68, and a helical spring used for biasing the latch member with respect to the housing, in the latch assembly of FIG. 1.
Figure 85:
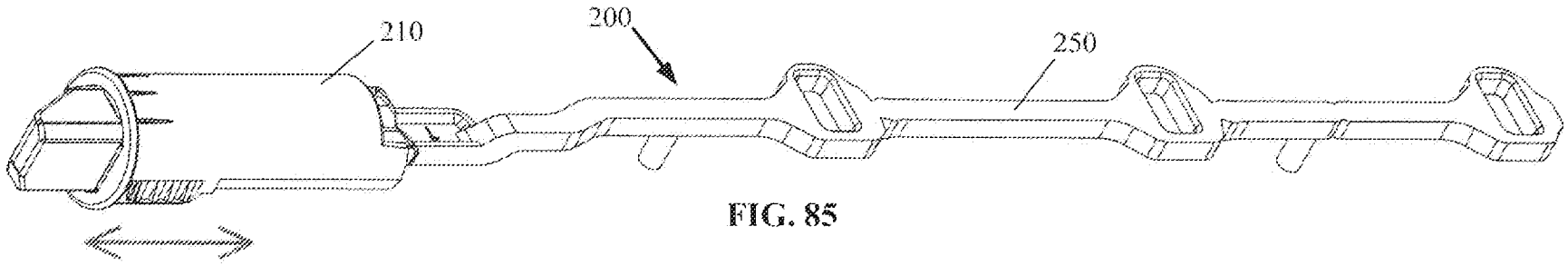
FIG. 85 is the perspective view of FIG. 84, but showing the latch member, the helical spring, and the latch housing after being assembled together, with the latch member biased into its extended position.
Figure 86:
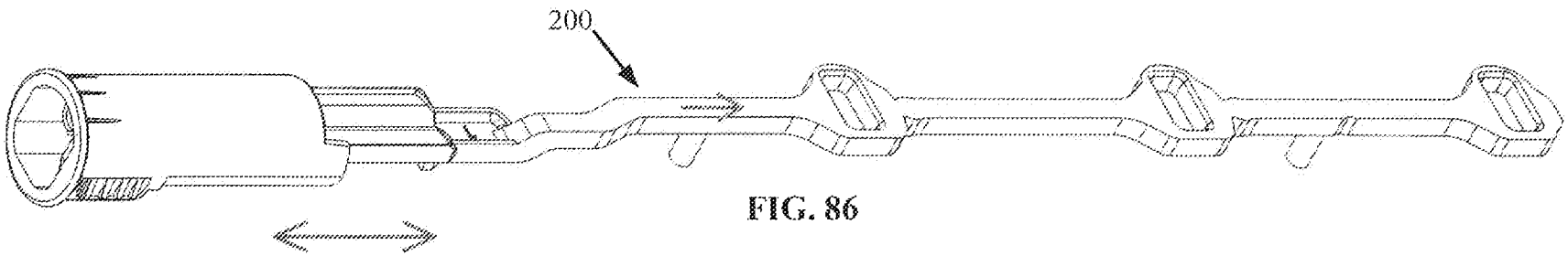
FIG. 86 is the perspective view of FIG. 85, but showing the latch member in a fully retracted position.
Figure 87:
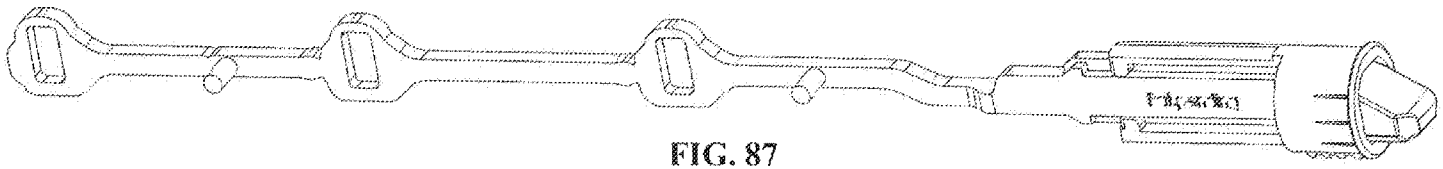
FIG. 87 is a reverse perspective view of the latch assembly shown in FIG. 85.
Figure 88:
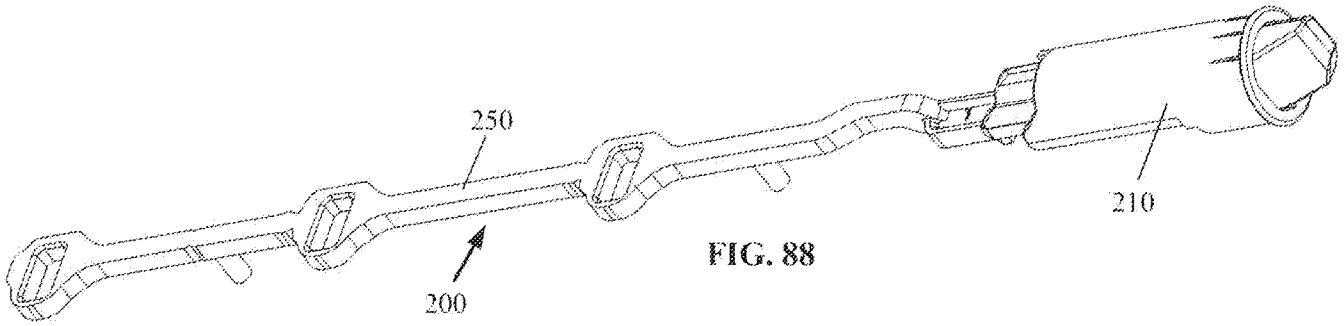
FIG. 88 is another perspective view of the latch assembly shown in FIG. 85.
Figure 90:
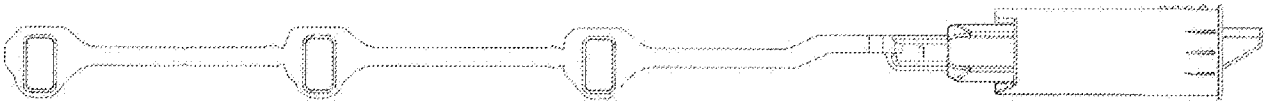
FIG. 90 is a top view of the latch assembly shown in FIG. 85.
Figure 89:
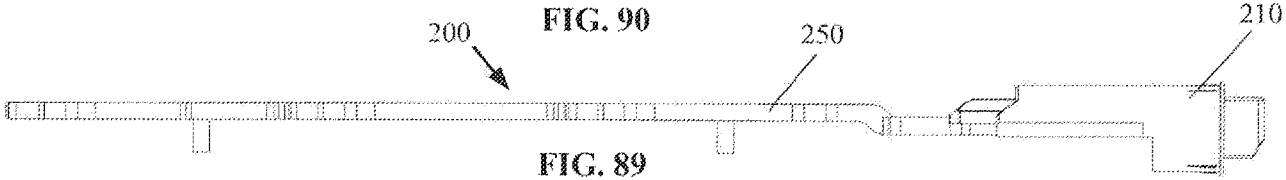
FIG. 89 is a side view of the latch assembly shown in FIG. 85.
Figure 91:
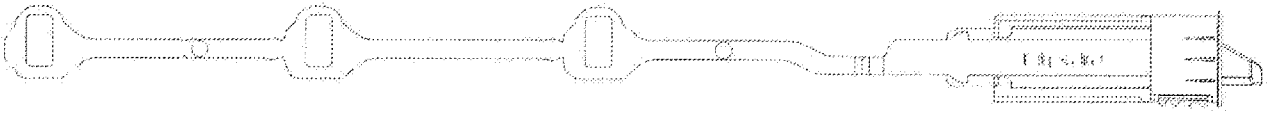
FIG. 91 is a bottom view of the latch assembly shown in FIG. 85.
Figure 92:
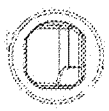
FIG. 92 is a first end view of the latch assembly shown in FIG. 85.
Figure 93:
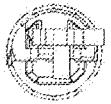
FIG. 93 is a second end view of the latch assembly shown in FIG. 85.
Figure 110:
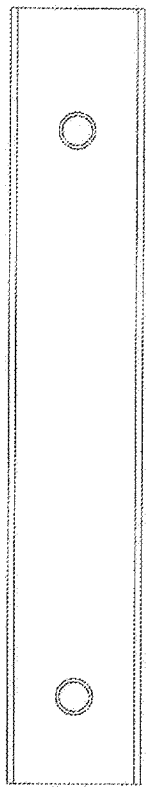
FIG. 110 is a rear view of the stepped stop of FIG. 103.
Figure 109:
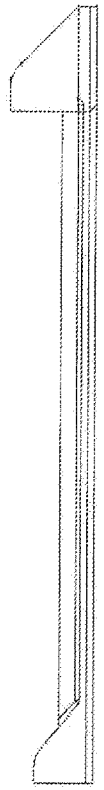
FIG. 109 is a second side view of the stepped stop of FIG. 103.
Figure 111:
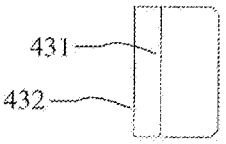
FIG. 111 is an end view of the stepped stop of FIG. 103.
Figure 107:
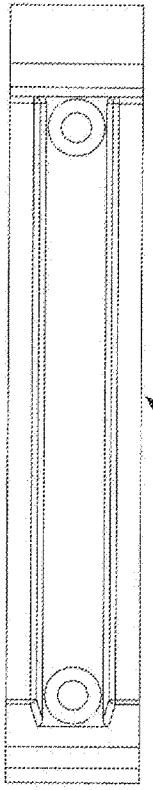
FIG. 107 is a front view of the stepped stop of FIG. 103.
Figure 108:
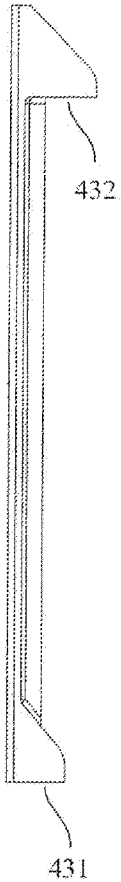
FIG. 108 is a first side view of the stepped stop of FIG. 103.
Figure 104:
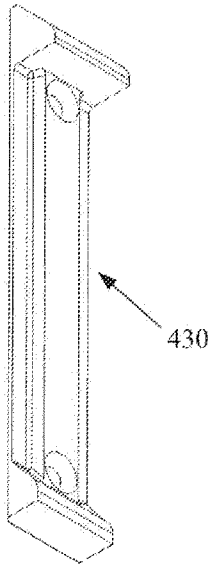
FIG. 104 is a second perspective view of the stepped stop of FIG. 103.
Figure 106:
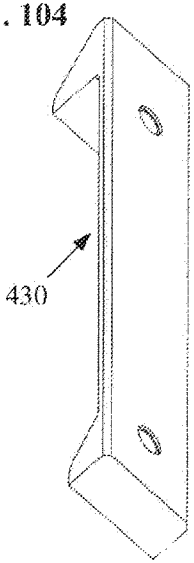
FIG. 106 is a fourth perspective view of the stepped stop of FIG. 103.
Figure 103:
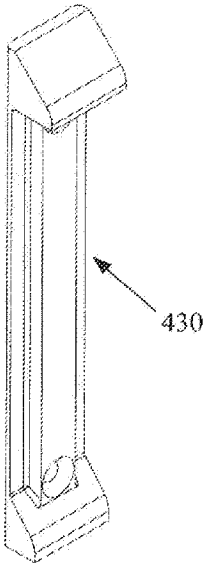
FIG. 103 is a first perspective view of the stepped stop used in conjunction with the latch assembly, as seen in FIG. 1.
Figure 105:
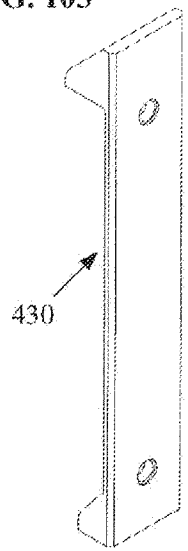
FIG. 105 is a third perspective view of the stepped stop of FIG. 103.
Figure 112:
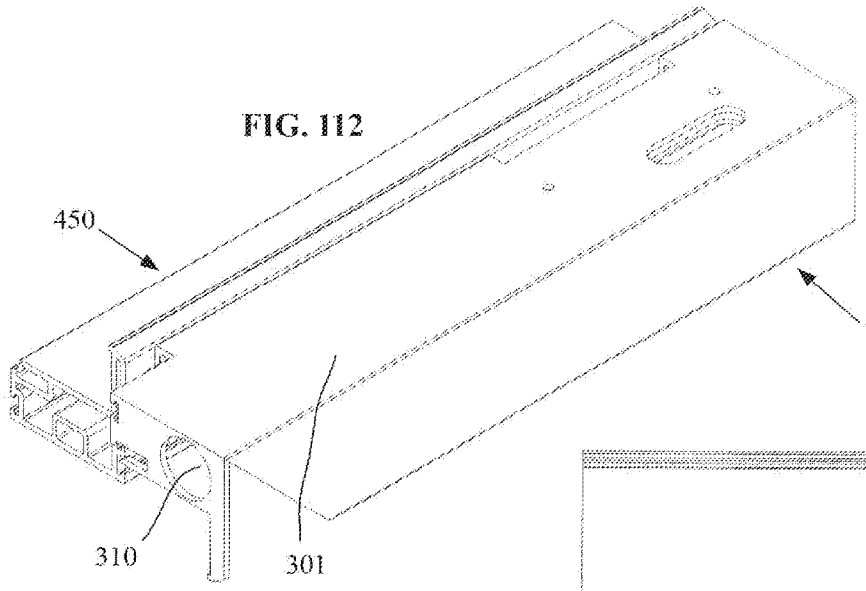
FIG. 112 is a perspective view of a meeting rail of a sash window frame engaged with a master window frame (or a second sash window frame) in the window closed position, and showing a cutout on the top of the meeting rail to receive the lever arm of the sash lock assembly, a pair of holes on the top of the meeting rail to receive a pairs of screws for mounting of the sash lock assembly thereto, and an opening in the side of the window frame to receive a latch assembly therein.
Figure 115:
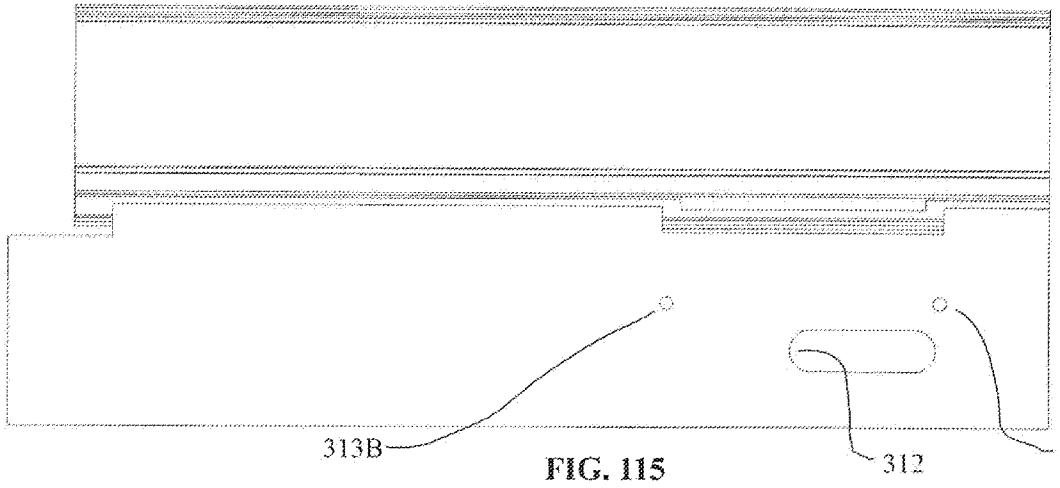
FIG. 115 is a top view of the sash window frame engaged with the master window frame, as seen in FIG. 112.
Figure 113:
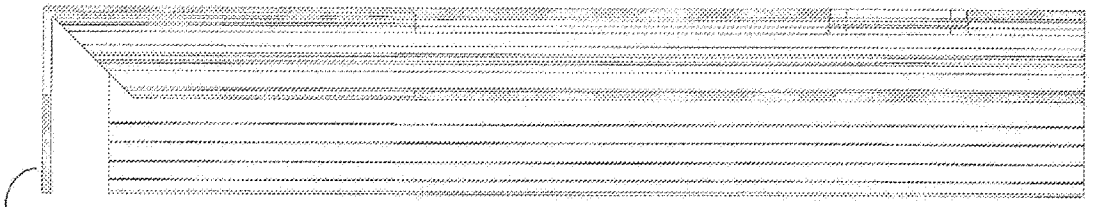
FIG. 113 is a front view of the sash window frame engaged with the master window frame, as seen in FIG. 112.
Figure 114:
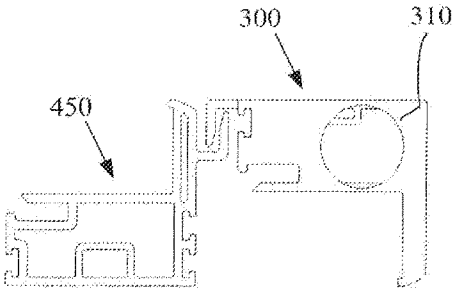
FIG. 114 is an end view of the sash window frame engaged with the master window frame, as seen in FIG. 112.

Assembly of the helical compression spring 291 and the latch member 250 into the housing 210 is illustrated initially in FIG. 84. The helical spring 291 may be nested in a recess 253R proximate to the tongue 253. One end of the spring may act upon the wall 253W of the tongue 253, while the other end of the compression spring may act upon the wall 218 of the housing 210 (FIG. 73), to bias a portion of the tongue, including its apex, to protrude out from the latch housing, as seen in FIG. 85. The extent that biasing by spring 291 may cause the tongue 253 to protrude out from the housing 210 may be limited by the stops 266A and 266B on the tongue (FIG. 81) contacting the stops 216A and 216B on the housing (FIG. 70). Actuation of the latch member 250 relative to the housing 210 may cause the apex of the tongue to retract within the hollow of the housing, as seen in FIG. 86.

Figure 116:
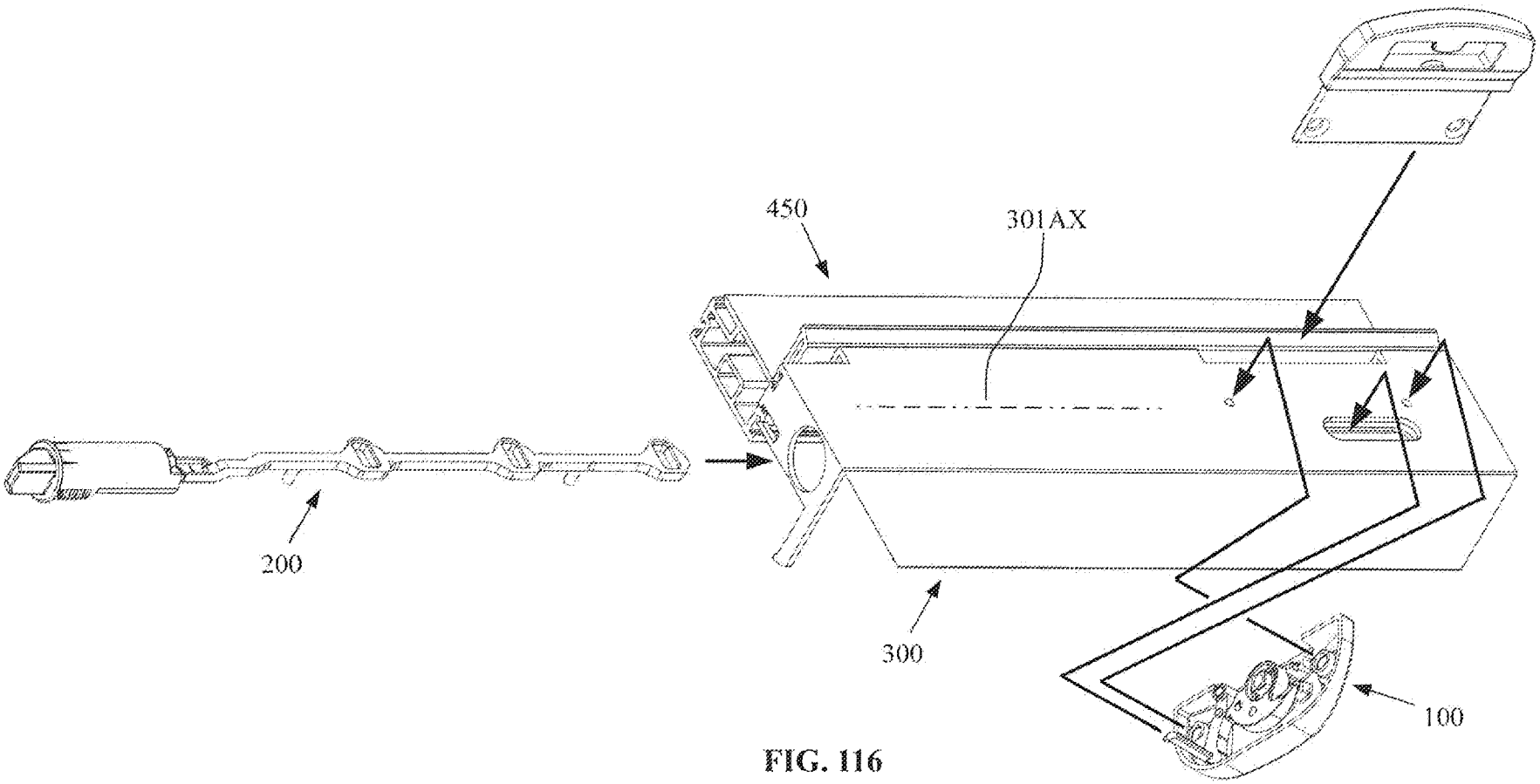
FIG. 116 is an exploded view showing the sash window frame engaged with the master window frame, as seen in FIG. 112, and also showing the latch assembly of FIG. 85, the sash lock assembly of FIG. 53, and the keeper of FIG. 94, prior to respective installation with respect to the sash window frame and the master window frame.
Figure 118:
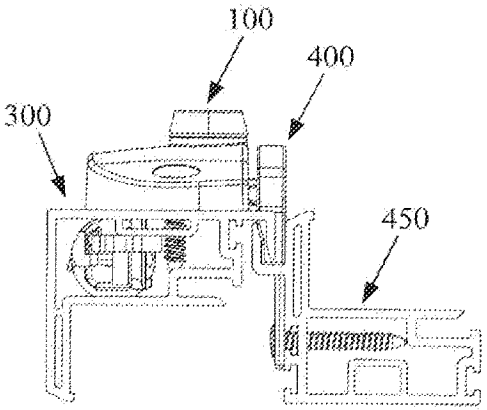

A suitable keeper 400 is shown in FIGS. 94-102, the installation of which upon the master window frame 450 is shown in FIG. 116 and FIG. 118. A suitable stepped stop member 430, for use in combination with the latch assembly 200 disclosed herein, is defined in FIGS. 103-111, and may include a first step 431, and a second step 432. (Note that two separate stop members may be used and be separately mounted to the master window frame instead of the two-stepped stop member 430).

To accommodate installation of the latch assembly 200, the sash window frame 300, as illustrated in FIGS. 112-115, may have an opening 310 on one side of the frame. The sliding sash window 300 may have a horizontal meeting rail 301, a first vertical stile 302A extending downward therefrom, and a second stile (not shown) and a bottom rail (not shown), which may form a framed enclosure to support the glazing therein.

To accommodate installation of the sash lock assembly 100, the top of the meeting rail 301 may have an elongated opening 312 formed therein, adjacent to which may be a first hole 313A, and a second opening 313B. The elongated opening 312 may be shaped and positioned to suitably provide clearance for the post 76 of the lever arm 70, and for its movement between the extended locking position (FIG. 60) and the third retracted unlock position (FIG. 63).

Figure 117:
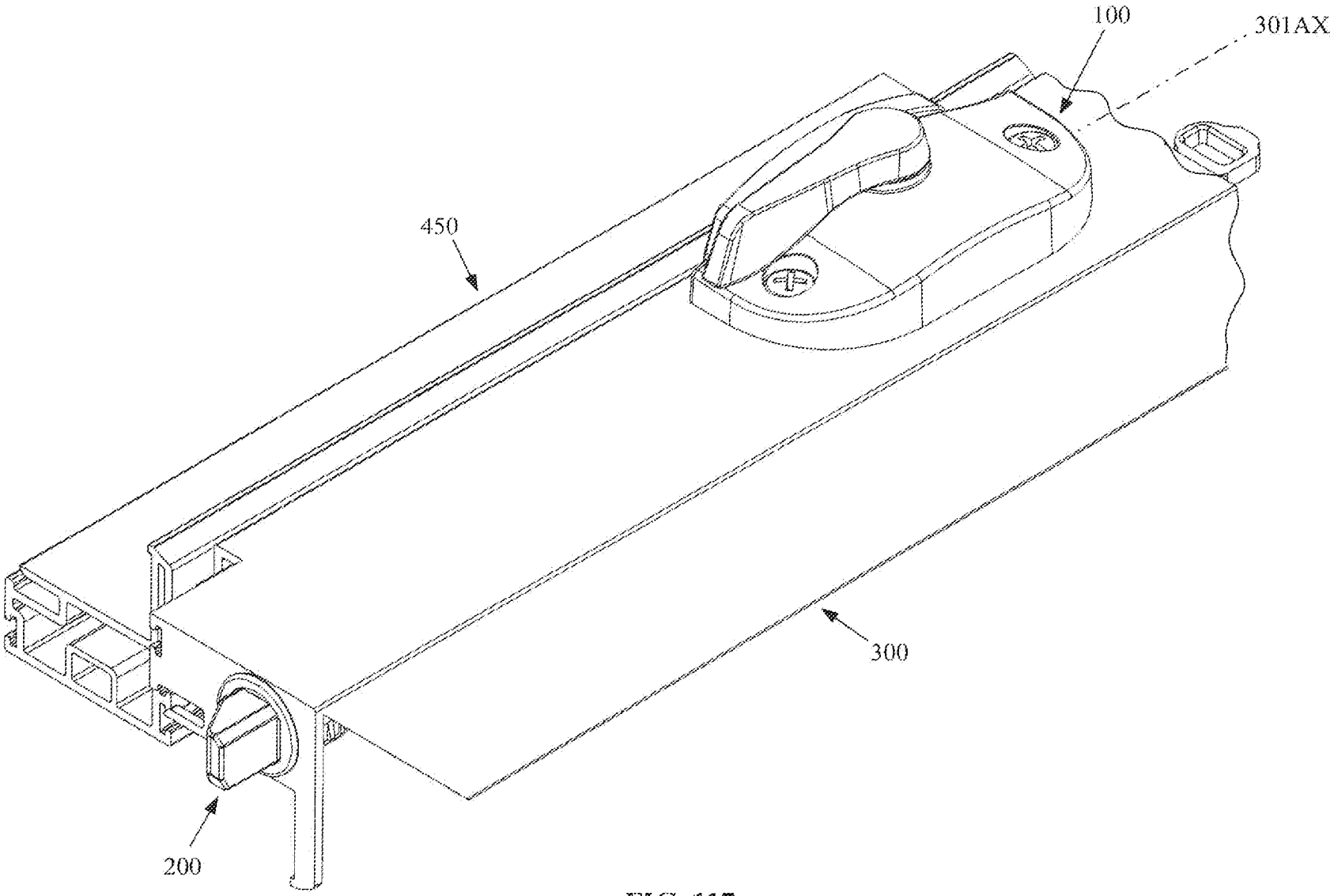
FIG. 117 shows the perspective view of the meeting rail of the sash window frame engaged with the master window frame, as seen in FIG. 116, but after installation of the tilt latch and the sash lock with respect to the sash window frame, and after installation of the keeper upon the master window frame.
Figure 119:
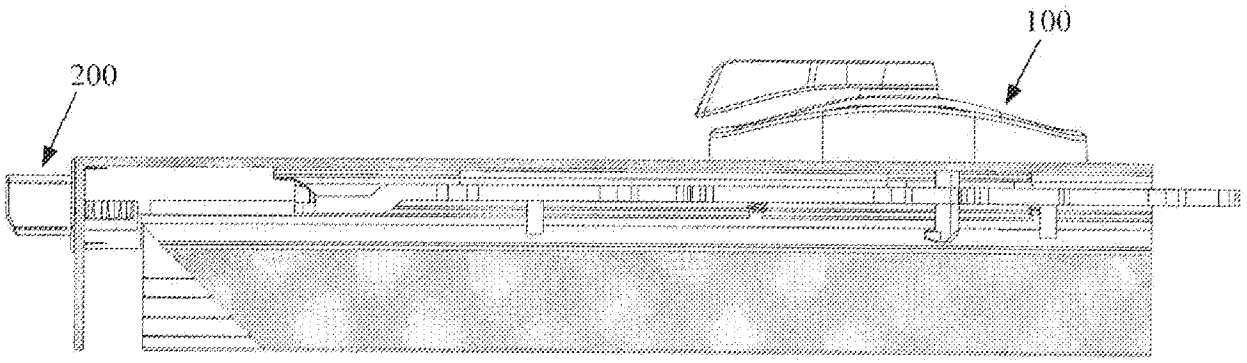

The initial installation of the latch assembly 200 is shown in FIG. 116. The end of the latch assembly 200 may be received through the opening 310 in the window frame 300, to be as seen in FIGS. 117-119.

One or more of the beams (255, 255A, and 255B) of the latch member may be formed to include a vertical protrusion. For example, beams 255 and 255B of the latch member 250A are formed to each include a respective vertical protrusion 255P1/255P2 that may protrude down from the bottom surface of the beam. The protrusions 255P1/255P2, which may be cylindrical, may be formed of a selective length so as to contact the bottom wall of the meeting rail 301A to provide support for the beam to be maintained at a substantially horizontal position, which may be a substantially central position within the hollow meeting rail of the sash window, or may be just a desired height above the bottom wall of the meeting rail. The protrusions 255P1/255P2 may also serve to prevent disengagement of the post 76 of the lever arm 70 from the opening.

The suitable opening (e.g., 275A, 275B, or 275C) on one of the beams (e.g., 255, 255A, or 255B) of the latch assembly 200 may be coordinated with and properly positioned for alignment below the top opening 312 in the meeting rail 301 of the window frame 300 (see FIG. 119). For the window frame 300 shown in FIG. 116, the elongated opening 312 in the meeting rail 301 may be positioned a particular distance away from the end of the window frame, which may accommodate alignment with opening 275B of the latch assembly 200 shown therein. In this case, the beam 255B could be removed using the notches 255BN1 and 255BN2, leaving the protrusion 266P2 to support the end of the latch member. For a larger window, the elongated opening in the top of the meeting rail may be more appropriately positioned to be a greater distance away from the end of the window frame, and may thus be positioned for alignment with opening 275C of the latch assembly 200. Similarly, for a smaller window, the elongated opening in the top of the meeting rail may be positioned a smaller distance away from the end of the window frame, and may be positioned for alignment with opening 275A of the latch assembly 200. In the latter example, the connection of the beam 255A with the peripheral walls formed about opening 275A may be severed using notches 255N1 and 255N2.

The initial installation of the sash lock assembly 100 upon the sash window frame 300 is also illustrated in the exploded view of FIG. 116. The post 76 of the lever arm 70 of the sash lock assembly 100 may be received through the opening 312 in the top of the meeting rail 301. However, because of the elongated cross-sectional shape of the post 76 (see FIG. 38), and because of the protrusion 77 protruding laterally therefrom, for the post to be also be received through the elongated opening 275B of the latch member 250 of the latch assembly 200, the lock assembly should be positioned substantially transverse to the axial direction 301AX of the meeting rail 301A. Such initial positioning may orient the long transverse direction of the post 76 and the protrusion 77 of lever arm 70 to be perpendicular to the axial direction 301AX of the meeting rail 301A, so that it may be generally in-line with the lengthwise side 275L of the rectangular opening 275A in the latch member 250.

After insertion of the post 76 through the opening 312 in the top of the meeting rail 301 and into the rectangular opening 275B of the latch bean, the sash lock assembly 100 may then be rotated roughly 90 degrees, and then may be lowered for the bottom surface 11 of the sash housing to contact and be flush with the top of the meeting rail, and be fastened to the holes 313A and 313*b* therein, using fasteners through the hollow cylindrical protrusions 15 and 16 of the housing 10. The 90 degree rotation of the sash lock assembly 100 just prior to its mounting of the sash lock to the meeting rail may orient the long transverse direction of the post 76 of lever arm 70 to be parallel to the axial direction 301AX of the meeting rail 301A, so that it may be generally in-line with the shorter width 275W of the rectangular opening 275A in the latch member 250.

The width 275W of the rectangular opening 275A in the latch member 250 may be just slightly larger than the long transverse direction of the post 76 of the lever arm 70 positioned therein, so that movement of the post actuates the latch member of the latch assembly, to provide the interconnection therebetween. The protrusion 77 may redundantly serve to prevent disconnection of the post 76 of the lever arm from the opening 275B in the latch member (i.e., preventing the latch member from falling off of the post), in conjunction with the protrusions 255P1 and 255P2 that may serve to maintain the latch beam(s) (e.g., 255, 255A, and 255B) at the proper elevation within the meeting rail. For further information regarding this aspect of the installation, if required, a more detailed description and corresponding illustrations are provided within Applicant's co-pending application Ser. No. 14/278,226.

The sash lock assembly 100 and the latch assembly 200 are shown installed with respect to the sliding sash window 300, in FIGS. 117-119, with the sash window slidably installed with respect to the master window frame 450.

Figure 122:
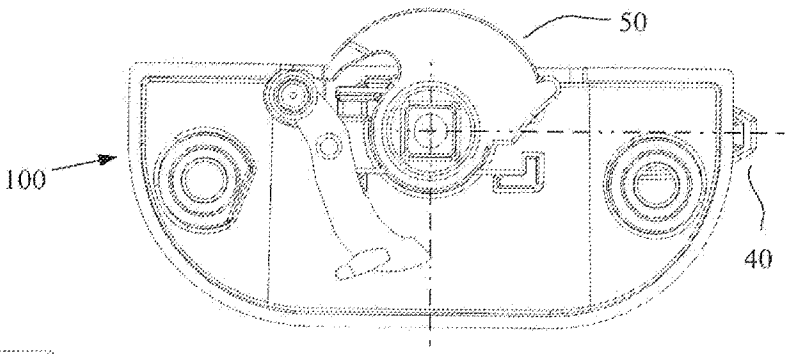
Figure 121:
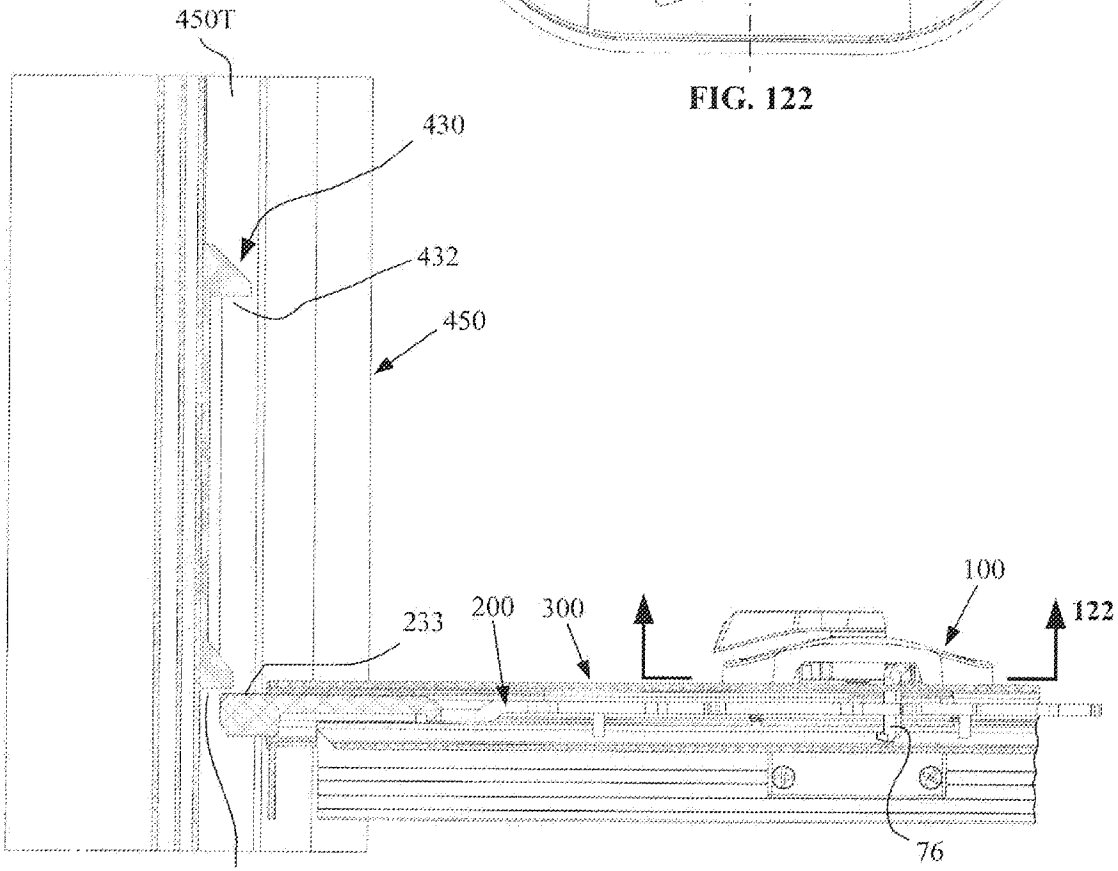
Figure 120:
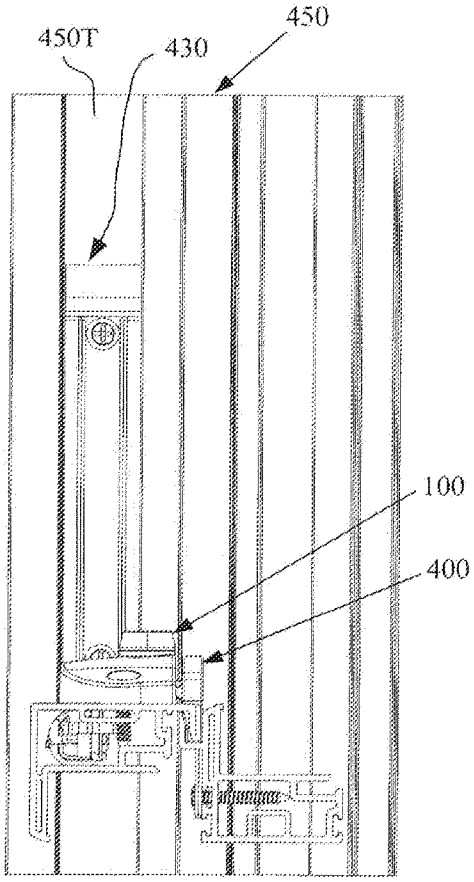
Figure 123:
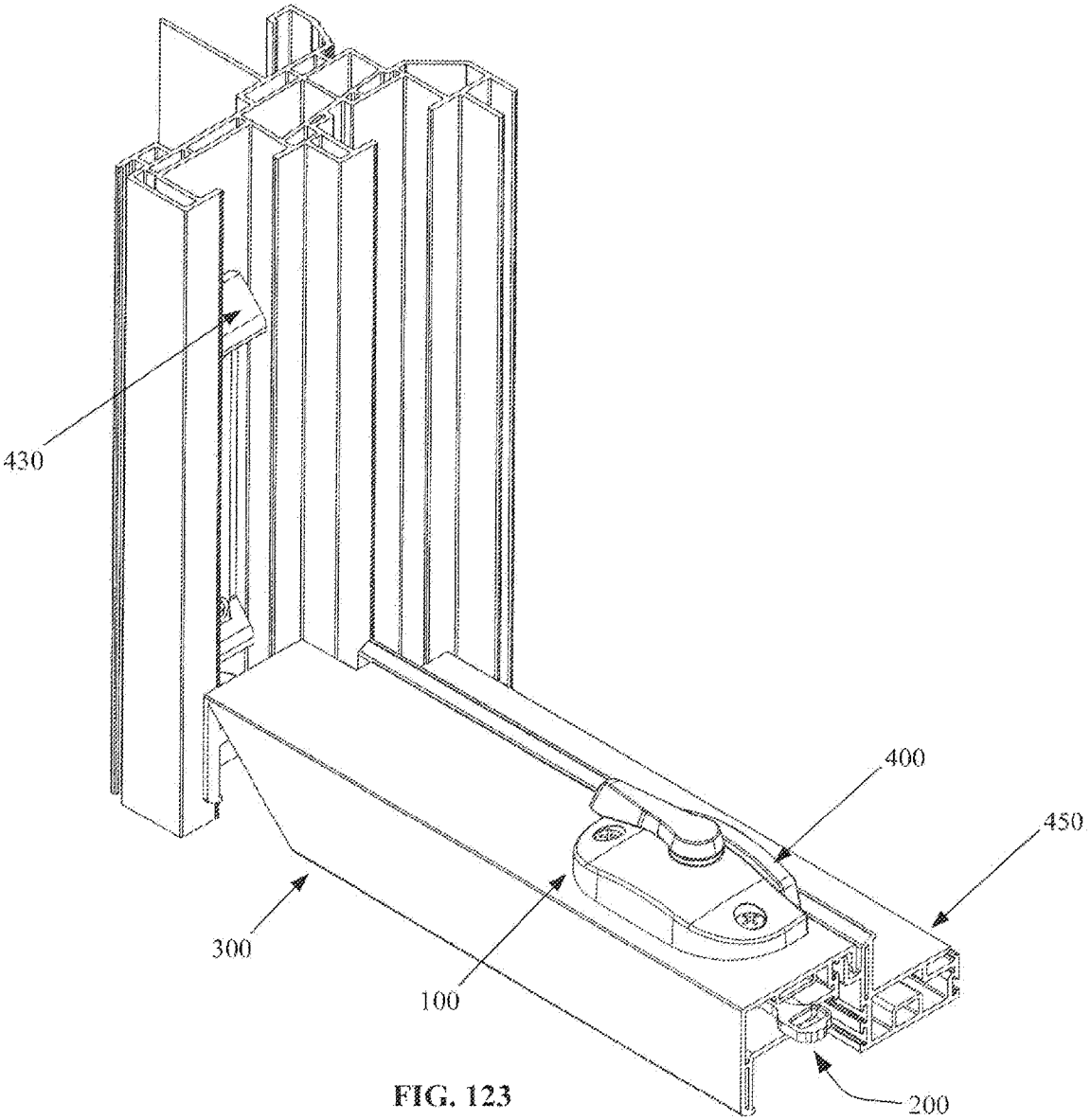

FIGS. 120, 121, and 123 show the stop member 430 installed within a track 450T of the master window frame 450—the track within which the tongue of the latch member 200 moves for the sash window 300 to be slidable with respect to the master window frame. The sash fastener is shown locked and latched, preventing the sash window from either sliding or tilting, as the sash lock 100 is shown with the shaft/handle member 40 and cam 50 in the extended lock position (FIG. 122) where the cam engages the keeper 400 (FIG. 120) to prevent sliding, and where the post 76 of the sash lock does not oppose the spring 291 from biasing the latch member 250 into its corresponding extended position, so that a portion of tongue 253 is disposed within track 450T to prevent tilting. The sash window 300 may be redundantly locked and prevented from sliding, as the first step 431 of the stop 430 may be positioned just above the top of the tongue 253 of the latch member 250, to block any upward movement of the sash window 300 from its closed position.

Figure 126:
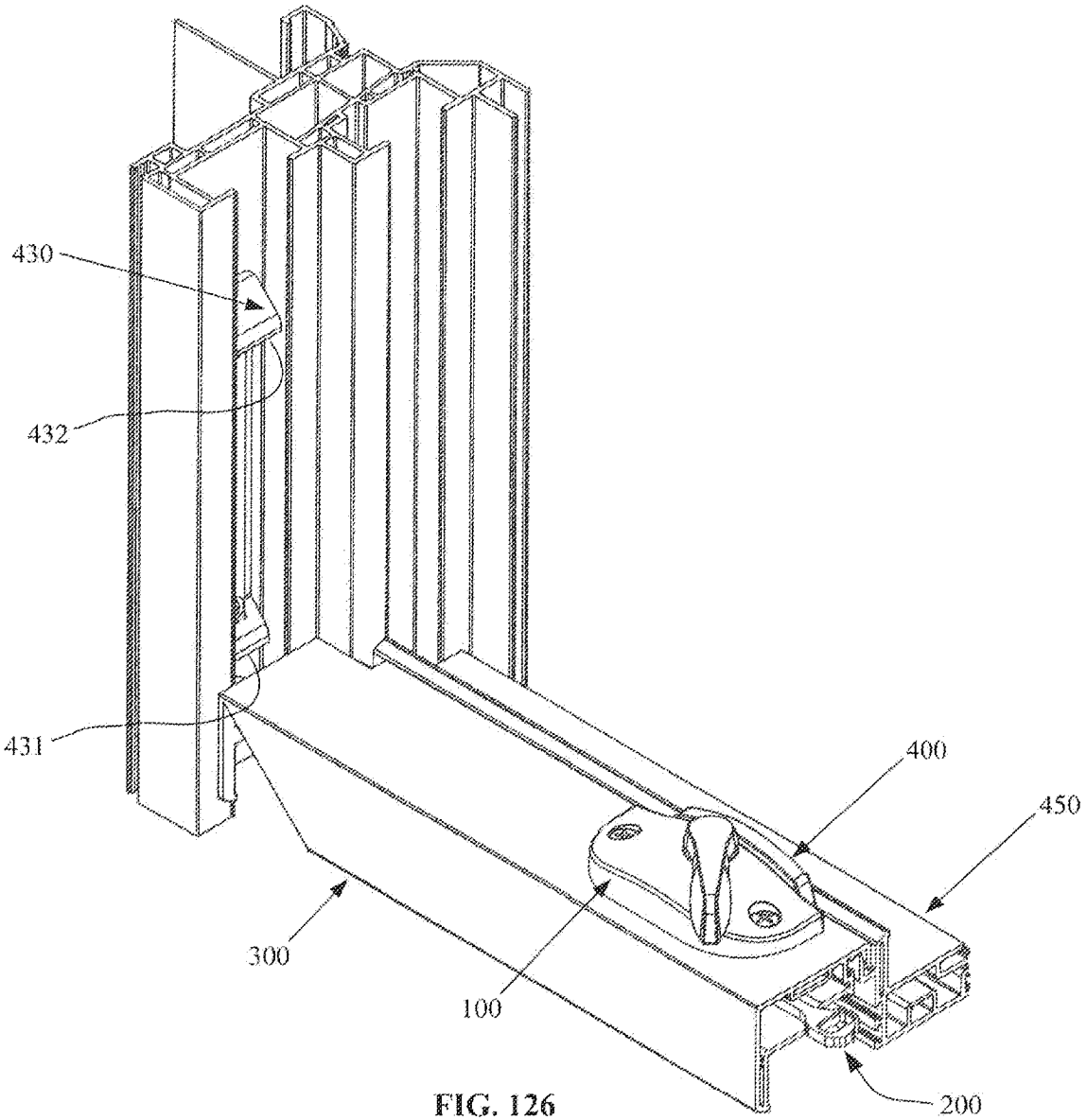
Figure 128:
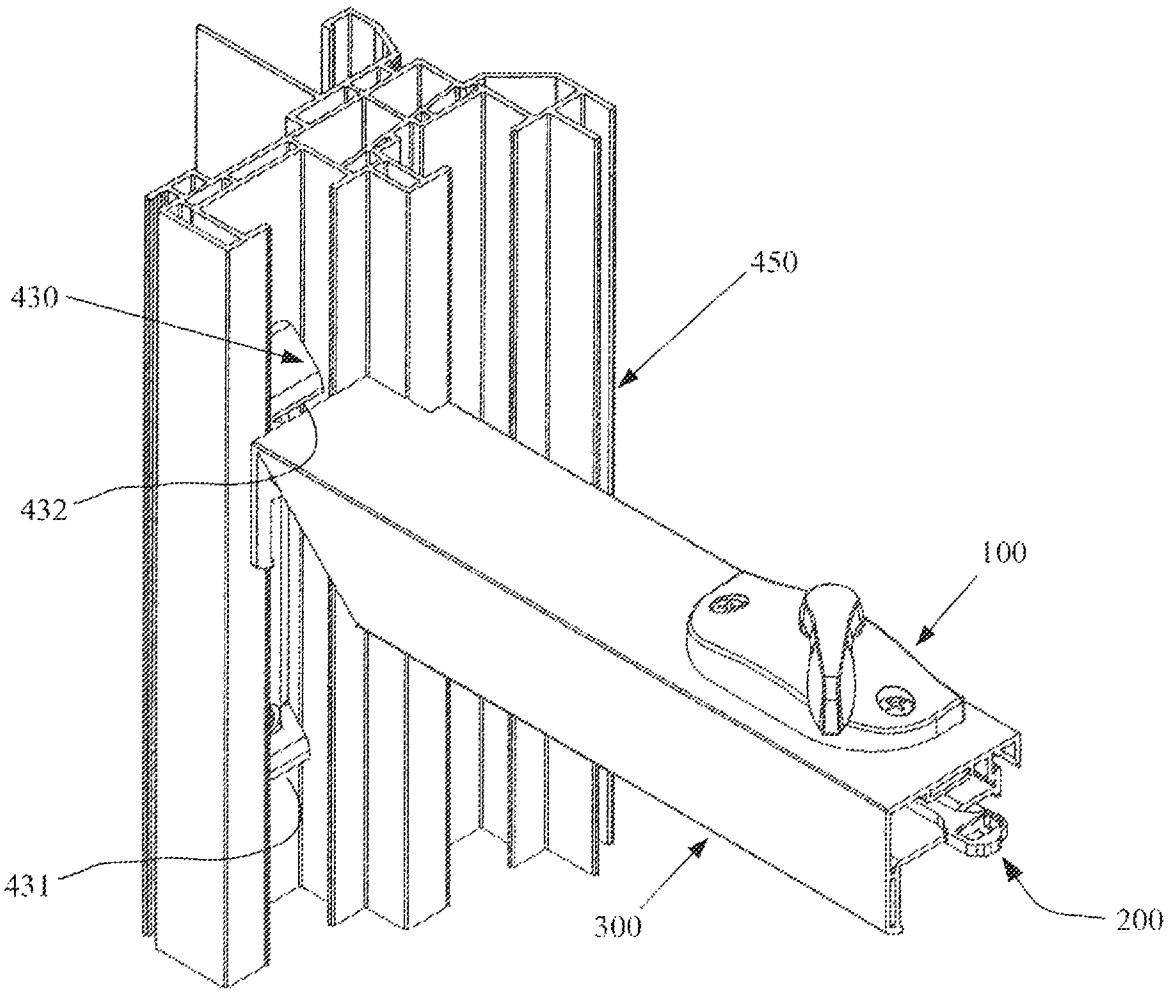

FIGS. 124 and 126 show the sash fastener unlocked and latched, permitting the sash window to slide upwardly from its closed position, but still being prevented from tilting. The shaft/handle member 40 and cam 50 of the sash lock 100 has been rotated 135 degrees to be in the first retracted unlock position (FIG. 125B), where it has disengaged from the keeper 400 to permit sliding, and the lever arm 70 of the sash lock has been driven to rotate by the cam a discrete amount (compare FIG. 125A and FIG. 125B) causing the post 76 to countered biasing of latch member 250 by spring 291 to be moved into its corresponding first retracted position. With the tongue 253 in its first retracted position, a portion thereof is still disposed within track 450T to prevent tilting. However, the sash window 300 is no longer redundantly prevented from sliding upward from its closed position, as the end of the tongue 253 has been moved sufficiently to clear the first step 431 of the stop 430. But the second step 432 of the stop 430 protrudes further into the track than the first step 431, and is positioned above the top of the tongue 253 of the latch member 250 (see arrow 2331), to thereat block upward movement of the sash window 300 beyond the open-limited window position shown in FIGS. 127 and 128. The distance that the second step 432 is positioned above the first step 431 of the stop 430 may be selected to limit upward movement of the window to a position that may be sufficient to provide ventilation, but which may still be small enough to prevent a small child from egressing therefrom. Additional steps may be utilized for the stop 430 to provide for other window open limited positions, or alternatively, separate stop members may be utilized and mounted within the track 450T of the master window frame 450.

FIGS. 129, 130B, and 131B show the sash fastener unlocked and latched, but now permitting the sash window to slide upwardly beyond its open-limited position, and still being prevented from tilting. The shaft/handle member 40 and cam 50 of the sash lock 100 has been rotated an additional 25 degrees (compare FIGS. 130A and 130B) to be in the second retracted unlock position (FIGS. 130B and 131B), where the post 76 of the lever arm 70 of the sash lock, as described hereinabove, has been actuated another discrete amount and has countered biasing of the latch member 250 by spring 291 for the latch member to be moved into its corresponding second retracted position. With the tongue 253 of the latch member 250 in its second retracted position, a portion thereof is still disposed within track 450T to prevent tilting. However, the sash window 300 is no longer prevented from sliding upward beyond its window limited position, as the end of the tongue 253 has been moved sufficiently to also now clear the second step 431 of the stop 430 (see arrow 233V'). However, as noted above, the semi-cylindrical protrusion 56P of the locking cam may contact and rest against the step 75T merely to provide a tactile indication of such positioning, but which may be insufficient to retain the cam at that position, so that once the user releases the force being applied to the shaft/handle member 40, it may be biased back towards the first retracted unlock position (see e.g., FIGS. 127 and 135).

FIGS. 132, 133B, and 134B show the sash fastener unlocked and unlatched, now permitting the sash window to tilt out of the master window frame to permit the outside of the glazing to be easily cleaned. The shaft/handle member 40 and cam 50 of the sash lock 100 has been rotated an additional 20 degrees (compare FIGS. 133A and 133B) to be in the third retracted unlock position (FIGS. 133B and 134B), where the post 76 of the sash lock, as described hereinabove, has been actuated another discrete amount and has countered biasing of the latch member 250 by spring 291 for it to be moved into its corresponding third retracted position. With the tongue 253 in its third retracted position, it is no longer disposed within track 450T to prevent tilting.

Once the outside of the glazing of the window 300 has been cleaned, the window may be pivoted back into the master window frame 450, and the shaft/handle member may be moved back into the second retracted position, where it may be biased back into the first retracted unlock position, or the user may simply move the shaft/handle member 40 to directly place the shaft/handle member 40 and can 50 in the first retracted unlock position (see e.g., FIGS. 127 and 135), to permit sliding of the window, and to prevent it from inadvertently tilting away from the master window frame.

As seen in FIG. 135, a person may apply a downward force to the sash window 300 shown therein, so that it may be lowered to a position at or below its window limited position, without directly actuating the shaft/handle member 40 of sash lock 100, because the angled bottom surface 253A of the bottom of the tongue 253 may contact the upper surface 432U of the second step 432 of the stop 430, which may be similarly angled.

The contact therebetween may create a horizontal force component FC in the latch member 250, which may oppose the basing of the latch member and the retaining three of the detent mechanism, and may be transmitted to the post 76 of the lever arm 70 by the interconnection with the latch member, which may drive the cam 50 to counter-rotate a small amount. Since the tongue 253 of the latch member 250 only needs to retract a small amount to clear the second step 432 of the stop 430 for the sash window 300 to be lowered, the cam will not be driven to counter-rotate vary far from the first retracted unlock position. Thus, once the tongue 253 is below the second step 432 of the stop 430, the biasing of the latch member 250 by spring 291 may automatically move the cam 50 back into the first retracted unlock position, and similarly move the latch member 250 into its first retracted unlock position (e.g., FIG. 127).

The examples and descriptions provided merely illustrate preferred embodiments of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A window fastener, for use on a sash window configured to at least slide with respect to a master window frame, said window fastener comprising:

a sash lock comprising: a housing; a cam being movable relative to said housing to occupy at least three discrete positions comprising an extended locking position, a first retracted unlock position, and a second retracted unlock position; and a detent mechanism to releasably secure said cam at said extended locking position and at said first retracted unlock position;

a latch assembly comprising: a latch member; and a housing configured to slidably receive said latch member, said latch member interconnected with said sash lock and thereby configured to occupy a plurality of discrete positions each corresponding to said discrete cam positions; said latch assembly further comprising means for biasing said latch member and cam toward said extended position;

a stop member comprising: a base with a first step and a second step each formed to protrude away from said base with a bottom surface being substantially perpendicular to said base and a top surface being at an acute angle to said base; wherein said first step protrudes to a first distance away from said base, and said second step protrudes to a second distance away from said base, said second distance being greater than said first distance; and wherein said base member is configured to mount within a track of the master window frame with said second step positioned above said first step;

wherein said latch member of said latch assembly, at said extended locking position, engages the master window frame to prevent tilting, and engages said first step of said stop member to redundantly lock the sash window in a closed window position;

wherein said latch member of said latch assembly, at said first retracted unlock position, engages the master window frame to prevent tilting, and is disengaged from said first step to permit sliding of the sash window away from the closed window position, and is configured to engage said second step of said stop member to limit the sliding travel of the sash window to an open-limited position;

wherein said latch member of said latch assembly, when said cam is manually held at said second retracted unlock position, engages the master window frame to prevent tilting, and is disengaged from said second step to permit sliding of the sash window past the open-limited position; and wherein when said cam is no longer manually held at said second retracted unlock position, said biasing means biases said latch member and said cam back to said first retracted unlock position, and upon movement of the sliding sash window back to a position between the closed window position and the open-limited window position, said latch member being further configured to automatically retract further as it contacts said acutely angled top surface of said second step to traverse over said second step, and is thereafter biased back to said first retracted unlock position to automatically limit the sliding travel of the sash window to the open-limited position.

2. The window fastener according to claim 1, wherein said cam is further movable relative to said housing to occupy a third retracted unlock position, and wherein said latch of said latch assembly, at said third retracted unlock position, is disengaged from the master window frame to permit tilting of the sash window.

3. The window fastener according to claim 2, wherein said detent mechanism is further configured to releasably secure said cam at said third retracted unlock position.

4. A combination sash lock, tilt latch, and window vent stop fastener, for use on a frame of a sash window configured to slide and tilt with respect to a master window frame, said fastener comprising:

a latch assembly comprising: a housing having a first end and a second end, a latch member, and a biasing means; said latch member comprising an opening; said latch member slidably received within said housing to be slidable between at least one retracted position and an extended position where a portion of a first end of said latch member protrudes out from said housing first end; said biasing means configured for biasing said latch member toward said extended position; said latch assembly configured to be received through an opening in a first side of the sash window frame, with said housing of said latch assembly secured thereto;

a lock assembly configured to be mounted to the meeting rail of the sash window frame, said lock assembly comprising: a housing; a cam pivotally mounted to said lock housing and configured to engage a keeper on the master frame when rotated into an extended position to lock the sliding sash window in a closed position, said cam configured to rotate between said extended position, a first retracted position, a second retracted position, and a third retracted position; an arm pivotally mounted within said lock housing, and configured to have a portion thereof extend through an opening in the meeting rail, to be engaged within said opening in said latch member, for coupling of motion therebetween, said cam configured for rotation thereof to contact a follower portion of said arm to drive said arm to cause selective corresponding counter-rotation of said arm, and said coupled movement of said latch member; and a detent mechanism to releasably secure said cam at said extended locking position and at said first retracted unlock position;

a stop member comprising: a base with a first step and a second step each formed to protrude away from said base with a bottom surface being substantially perpendicular to said base and a top surface being at an acute angle to said base; wherein said first step protrudes to a first distance away from said base, and said second step protrudes to a second distance away from said base, said second distance being greater than said first distance; and wherein said base member is configured to mount within a track of the master window frame with said second step positioned above said first step;

wherein said latch member, when at a position corresponding to said extended lock position of said cam, engages the master window frame to prevent tilting, and engages said first step of said stop member to redundantly lock the sash window in the closed window position;

wherein said latch member, when at a position corresponding to said first retracted position of said cam: engages the master window frame to prevent tilting, and disengages from said first step to permit sliding of the sash window away from the closed window position, and is configured to engage said second step of said stop member to limit the sliding travel of the sash window to an open-limited position;

wherein said latch member, when at a position corresponding to said cam being manually held at said second retracted position, engages the master window frame to prevent tilting, and disengages from said second step to permit sliding of the sash window past the opened-limited window position;

wherein when said cam is no longer manually held at said second retracted unlock position, said biasing means biases said latch member and said cam back to said first retracted unlock position, and upon movement of the sliding sash window back to a position between the closed window position and the open-limited window position, said latch member being further configured to automatically retract further as it contacts said acutely angled top surface of said second step to traverse over said second step, and is thereafter biased back to said first retracted unlock position to automatically limit the sliding travel of the sash window to the open-limited position; and wherein said latch member, when at a position corresponding to said third retracted position of said cam, disengages from the master window frame to permit tilting of the sash window.

5. The combination sash lock, tilt latch, and window vent stop fastener according to claim 4, wherein said detent mechanism is further configured to releasably secure said cam at said third retracted position.

6. The combination sash lock, tilt latch, and window vent stop fastener according to claim 5, wherein said follower portion of said arm comprises a protrusion configured to releasably inhibit said driving of said arm by said cam rotation when at said second retracted position.

7. The combination sash lock, tilt latch, and window vent stop fastener according to claim 6, wherein said cam is rotated 135 degrees to reach said first retracted position from said extended lock position;

wherein said cam is rotated 25 degrees to reach said second retracted position from said first retracted position; and wherein said cam is rotated 20 degrees to reach said third retracted position from said second retracted position.

8. The combination sash lock, tilt latch, and window vent stop fastener according to claim 6, said detent mechanism comprising:

a first leaf spring and a second leaf spring fixedly mounted in said housing on opposite sides of said cam, and at a distance apart from each other;

said cam comprising: a cylindrical hub with a first pair of flats formed thereon to be at said distance apart; and a second pair of flats formed thereon to also be at said distance apart; said second pair of flats being clocked on said hub at 135 degrees from said first pair of flats;

wherein said first and second leaf springs are configured to engage said first pair of flats on said cam to releasably secure said cam at said extended lock position and at said third retracted position; and wherein said first and second leaf springs are configured to engage said second pair of flats on said cam to releasably secure said cam at said first retracted position.

* * * * *